United States Patent [19]

Shinoda et al.

[11] 4,249,104

[45] Feb. 3, 1981

[54] SELF SHIFT TYPE GAS DISCHARGE PANEL

[75] Inventors: Tsutae Shinoda, Akashi; Kazuo Yoshikawa; Shizuo Andoh, both of Kobe, all of Japan

[73] Assignee: Fujitsu Limited, Tokyo, Japan

[21] Appl. No.: 828,295

[22] Filed: Aug. 26, 1977

[30] Foreign Application Priority Data

Sep. 16, 1976 [JP] Japan ..... 51/111573
Oct. 5, 1976 [JP] Japan ..... 51/120142

[51] Int. Cl.[3] ..... H05B 37/00
[52] U.S. Cl. ..... 313/188; 313/217; 313/220
[58] Field of Search ..... 315/169.4, 169.2; 313/188, 217, 220

[56] References Cited

U.S. PATENT DOCUMENTS 3,898,515 8/1975 Andoh et al. ..... 315/169.4 X
3,944,875 3/1976 Owaki et al. ..... 313/188 X

*Primary Examiner*—Rudolph V. Rolinec
*Assistant Examiner*—Darwin R. Hostetter
*Attorney, Agent, or Firm*—Staas and Halsey

[57] ABSTRACT

A self shift type gas discharge panel in which pluralities of buses are respectively provided on a pair of substrates disposed opposite each other, electrodes are respectively connected to the buses and shift channels are set up in row and column directions with arrays of discharge points formed between the opposed electrodes of the substrates to enable shifting of a discharge spot in the row or column direction. On the substrates, the electrodes and the buses are so arranged as not to intersect each other, which allows ease in the manufacture of the discharge panel and ensures stable shifting of the discharge spot.

20 Claims, 28 Drawing Figures

SELF SHIFT TYPE GAS DISCHARGE PANEL

BACKGROUND OF THE INVENTION

1. Field of the Invention

This invention relates to a self shift type gas discharge panel having a function of shifting discharge spots, and more particularly to a self shift type gas discharge panel in which information written in the form of discharge spots can be sequentially shifted in either of the row and column directions.

2. Description of the Prior Art

There has heretofore been known, as one kind of gas discharge display panel, an AC driven plasma display panel having a matrix type electrode arrangement. This matrix type plasma display panel requires a complicated drive circuit for individually addressing a plurality of electrodes arranged in horizontal and a vertical directions, and has the disadvantage that an increase in the size of the plasma display panel leads to a marked increase in the cost of the drive circuit. To simplify such a drive circuit, there has recently been developed a self shift gas discharge panel having a function of shifting discharge spots.

A typical structure of this self shift gas discharge panel is disclosed in detail, for example, in U.S. Pat. No. 3,944,875 entitled "Gas Discharge Device Having a Function of Shifting Discharge Spots" by Owaki et al. This gas discharge device includes common electrodes disposed on one of a pair of substrates to extend in a horizontal direction (Y) and covered with a dielectric layer and a plurality of shift electrodes disposed on the other substrate to extend in a vertical direction (X) and similarly covered with a dielectric layer. The shift electrodes are sequentially and periodically connected with more than three buses and a shift channel is set up in accordance with the arrangement of discharge points formed between common electrode and shift. At one end of this shift channel, a write electrode is provided for inputting information to be displayed. A discharge spot, which is generated by applying a write pulse to the write electrode, is shifted to adjacent discharge points one after another by sequentially switching shift voltages to buses, utilizing the priming effect due to plasma coupling.

In such an intersecting electrode type self shift gas discharge panel, a plurality of shift electrodes must be sequentially connected with at least three buses on one of the two substrates. Accordingly, in the connection of the buses with the shift electrodes, it is necessary that at least one bus and the shift electrodes connected to the other buses be insulated from each other at the intersections thereof. This insulation is achieved by cross-over techniques but since the formation of such cross-over parts involves troublesome operations, the yield of the panel becomes low and enhancement of reliability of the panel is hindered. Further, in the case of reducing the pitch of the shift electrodes for providing a display with high resolution, the pitch of the cross-over parts is also required to be decreased. This makes the fabrication of the panel more difficult, and seriously hinders the realization of a high-resolution display panel.

Further, U.S. Pat. No. 3,775,764 entitled "Multi-Line Plasma Shift Register Display" by J. P. Gaur discloses a panel structure in which pluralities of parallel shift electrodes are disposed in a back and forth meander pattern on the inside of each of a pair of substrates, respectively, and in which the shift electrodes on each substrate are divided into two groups. This parallel electrode type self shift gas discharge panel eliminates the above-said defect attendant with formation of the cross-over parts, but presents a new problem in the separation of discharge spots in the direction of the shift electrodes, making it difficult to realize a structure capable of providing a high resolution display.

Moreover, U.S. Pat. No. 3,704,389 entitled "Method and Apparatus for Memory and Display" by W. B. McCleland sets forth a panel structure which employs shift electrodes of special patterns so as to shift a discharge spot by making use of the phnomenon that wall charges spread to the wall surfaces of adjoining discharge points. The shift electrodes of the special patterns provide a shift channel like a by-pass. However, this structure is impractical in that no consideration is paid to plasma coupling between adjacent discharge points, and it is very difficult to obtain a practical operation margin.

In view of the above, as panel structures which do not involve the cross-over parts and are excellent in the separation of discharge spots, there have been proposed a meander channel type self shift gas discharge panel, in which row electrodes connected to two-phase buses on one of a pair of substrates and column electrodes connected to two-phase buses on the other substrate are disposed opposite each other with a discharge gas space defined therebetween so that the electrodes on both the substrates extend across each other at right angles and in which a discharge spot is shifted along a shift channel like a by-pass, and a meander electrode type self shift gas discharge panel in which a linear shift channel is formed with sinuous electrodes. These self shift gas discharge panel structures are described in detail in U.S. patent applications Ser. Nos. 810,747 and 813,627 assigned to the same assignee as the present application.

The abovesaid panel structures are now briefly described. FIG. 1 is a diagram explanatory of the electrode arrangement of the meander channel type self shift gas discharge panel. In this discharge panel, column electrodes xai and xbi ($i=1, 2, 3, \ldots$) respectively connected to column electrode buses Xa and Xb on one of a pair of substrates, and row electrodes yaj and ybj ($j=1, 2, 3, \ldots$), respectively connected to row electrode buses Ya and Yb on the other substrate, are respectively covered with dielectric layers and disposed opposite each other with a discharge gas space defined therebetween so that the column and row electrodes may extend across each other at right angles. Further, write electrodes wj ($j=1, 2, 3, \ldots$) are disposed opposite the row electrodes yaj. A discharge spot is shifted along a bypass-like shift channel, for example, in the order of discharge points a-b-c-d- . . . . For the formation of the shift channel, barriers BR are provided between each pair of column electrodes xbi and xa ($i+1$) between the row electrodes yaj, between each pair of column electrodes xai and xbi between the row electrodes ybj, and between each pair of row electrodes yai and yb ($i+1$).

FIG. 2 illustrates an example of a series of drive waveforms for shifting a discharge spot in the abovesaid gas discharge panel. The buses Xa, Xb, Ya and Yb are supplied with pulse voltages Vxa, Vxb, Vya and Vyb, respectively. The pulse interval t1 of the pulse Vxa, the pulse width t2 of a shift pulse Vsh and the pulse width t3 of an erase pulse Ve are selected to be, for instance, 15 $\mu$S, 5 to 10 $\mu$S and 1 to 2 $\mu$S, respectively. Reference characters Vaa, Vab, Vbb and Vba show the voltages across the corresponding discharge points as a result of the pulse voltages Vxa, Vxb, Vya and Vyb being applied to the corresponding electrodes.

For example, when a write pulse is applied to the write electrode w1 to produce a discharge spot at the write discharge point a and the shift pulse Vsh is applied to each of the buses Xa and Ya, the voltage indicated by Vaa is fed to the discharge point b, so that the discharge spot shifts to the discharge point b. Next, upon application of the shift pulses Vsh to the buses Xa and Yb, the voltage Vab is fed to the discharge point c to generate a discharge spot at the discharge point c due to plasma coupling, and then the erase pulse Ve is applied to the discharge point b to erase the discharge spot there, thus shifting the discharge spot from the discharge point b to c. Thereafter, the discharge spot is similarly shifted to the discharge points d, e, f, . . . one after another.

FIG. 3 is explanatory of the electrode arrangement of the meander electrode type self shift gas discharge panel. In this discharge panel, two buses XA and XB, electrodes xAi and xBi (i=1, 2, 3 . . . ) alternately connected to the buses XA and XB and write electrodes W1, W2 . . . are formed on one of a pair of substrates, and two buses YA and YB, and electrodes yAj and yBj (J=1, 2, 3, . . . ) alternately connected to the buses YA and YB are formed on the other substrate. The electrodes on both substrates are disposed opposite each other with a discharge gas space defined therebetween. The electrodes have electrode portions xa, xb, ya and yb, respectively, and the opposed parts of adjacent ones of the electrode portions form a unit discharge region, i.e. a discharge point. A dielectric layer is formed at least on each electrode portion.

For shifting the discharge spot, the waveforms shown in FIG. 2 can be used and the discharge spot is shifted in the row direction in which the electrode portions xa and xb are arranged.

The abovesaid meander channel type and meander electrode type self shift gas discharge panels eliminate the need for formation of the cross-over parts, as referred to above, but the structure of these panels allows shifting the discharge spot only in one direction.

SUMMARY OF THE INVENTION

An object of this invention is to provide a self shift type gas discharge panel of a novel construction which enables easy shifting of a discharge spot.

Another object of this invention is to provide a self shift type gas discharge panel of the construction which eliminates intersections of electrodes with buses on each substrate to remove the necessity of the formation of cross-over parts and hence permits simplifying of the manufacture of the panel.

Another object of this invention is to provide a self shift type gas discharge panel which enables shifting of a discharge spot in two directions.

Another object of this invention is to provide a self shift type gas discharge panel of the construction which ensures correct shifting of a discharge spot when shift of the discharge spot along a row or column is switched to shift along the column or row, respectively.

Still another object of this invention is to provide a self shift type gas discharge panel which stably performs a discharge spot shift operation and a stationary display operation.

Briefly stated, in this invention, a plurality of buses and a plurality of electrodes respectively connected thereto are formed on one of a pair of substrates, and a plurality of buses and a plurality of electrodes respectively connected thereto are similarly formed on the other substrate. A meander type shift channel is formed by barriers in at least one of row and column directions and a discharge spot is shifted in the row or column direction in accordance with the combination of shift pulses which are fed to the buses. Further, the electrodes are connected in a meander pattern to set up linear shift channels in the row and column directions and the discharge spot is shifted in the row or column direction in accordance with the combination of shift pulses which are applied to the buses.

Other objects, features and advantages of this invention will become more fully apparent from the following description of preferred embodiments of this invention taken in conjunction with the accompanying drawings.

DESCRIPTION OF THE PREFERRED EMBODIMENTS

Figure 4:
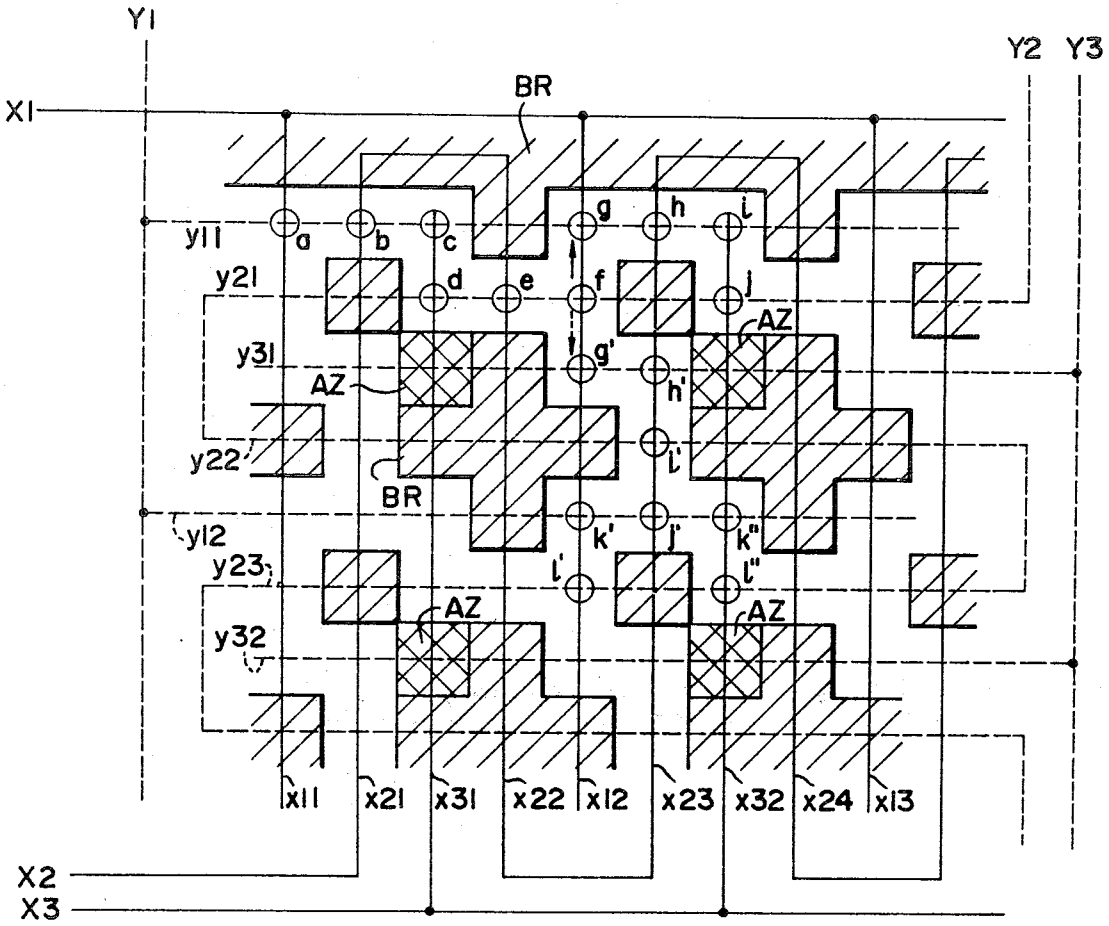
FIG. 4 is a schematic diagram explanatory of an electrode arrangement for use in an embodiment of this invention.

FIG. 4 shows an electrode arrangement employed in an embodiment of this invention, which is of the meander channel type. On one of a pair of substrates, buses X1 to X3 and electrodes x1i to x3i (i=1, 2, 3, . . . ) are formed, as indicated by the solid lines, and, on the other substrate, buses; Y1 to Y3 and electrodes y1j to y3j (j=1, 2, 3, . . . ) are similarly formed, as indicated by the broken lines. The electrodes formed on each substrate are respectively covered with dielectric layers, and disposed opposite each other with a discharge gas space defined therebetween. Though not shown, write electrodes are provided on one of the two substrates.

The electrodes x1i and x3i are connected to the buses X1 and X3 on both sides thereof, respectively, and the electrodes x2i are connected to extend in meander pattern between the electrodes x1i and x3i, and are connected to the bus X2. The electrodes y1j and y3j are connected to the buses Y1 and Y3 on both sides thereof, respectively, and the electrodes y2j are connected to extend in meander pattern between the electrodes y1j and are y3j, and connected to the bus Y2. Further, barriers BR are provided in the form of islands so that shift channels may be set up in the row and column directions. That is, the shift channels are formed to extend in a meander pattern in the row and column directions. Those parts of the barriers BR which are indicated by AZ may be left out.

As described above, the three-phase buses X1 to X3 and Y1 to Y3 are provided but, on each substrate, no cross-over parts are formed.

Figure 5:
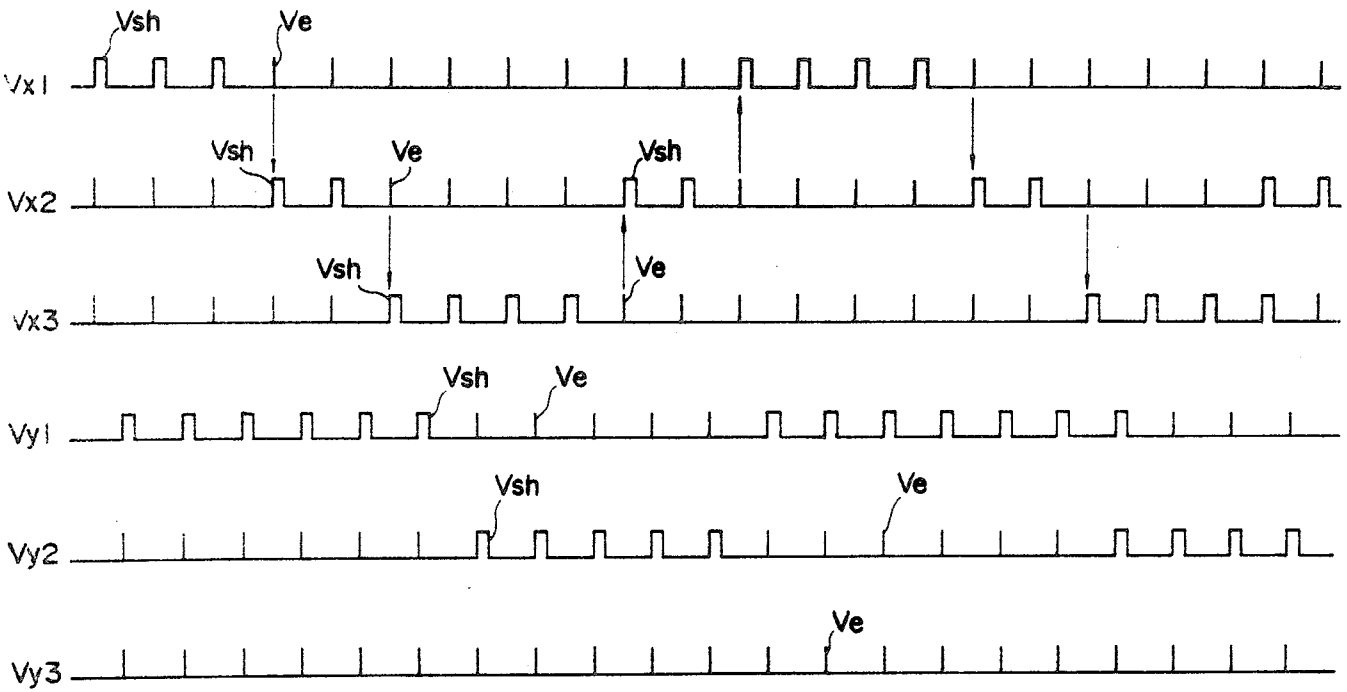
FIG. 5 is a waveform diagram showing an example of drive waveforms for shifting a discharge spot in the row direction of the electrode arrangement of FIG. 4.

FIG. 5 illustrates an example of a series of drive waveforms for the row shift operation. Reference characters Vx1 to Vx3 show pulse voltages applied to the buses X1 to X3, respectively; Vy1 to Vy3 show pulse voltages applied to the buses Y1 to Y3, respectively; Vsh shows shift pulses; and Ve shows erase pulses.

In FIG. 4, assuming that a discharge spot, generated by applying a write pulse to a write electrode (not shown), has shifted to a discharge point a at the timing of applying the shift pulses to the buses X1 and Y1, the discharge spot shifts to a discharge point b with the next application of the shift pulses Vsh to the buses X2 and Y1. Then, upon application of the shift pulses Vsh to the buses X3 and Y1, the discharge spot shifts to a discharge point c. The combination of the discharge points with the buses supplied with the shift pulses is as follows: a(X1,Y1), b(X2, Y1), c(X3, Y1), d(X3, Y2), e(X2, Y2), f(X1, Y2), g(X1, Y1), h(X2, Y1), i(X3, Y1) and j(X3, Y2). The arrows in FIG. 5 indicate the timing and direction of the shifting of the discharge spot along the discharge points. In this case, the pulse width of the erase pulse Ve at the timing indicated by the arrow can be selected to range from 1 to 5 μS. This pulse is referred to as an overlap pulse.

In the row shift, use is made of the three-phase buses X1 to X3 and the two-phase buses Y1 and Y2 and, in the period of application of the shift pulse to the bus Y1, the shift pulses are fed to the three-phase buses in the order X1-X2-X3 and, in the period of application of the shift pulse to the bus Y2, the shift pulses are fed to the three-phase buses in the order X3-X2-X1. Such order of application of the shift pulses Vsh can be easily set by the employment of a logic circuit. Further, since the erase pulse Ve is fed to the discharge point from which the discharge spot has shifted, a wall charge at the discharge point will immediately disappear.

Figure 6:
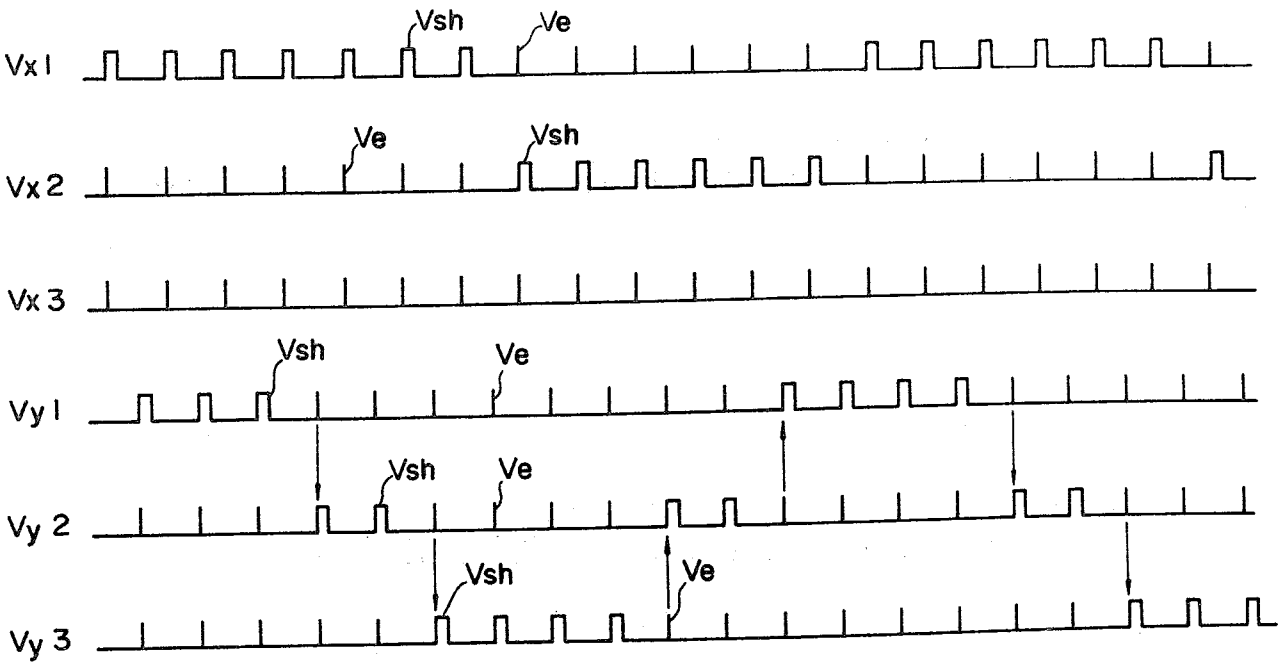
FIG. 6 is a waveform diagram illustrating an example of drive waveforms for shifting the discharge spot in the column direction of the electrode arrangement of FIG. 4.

FIG. 6 shows an example of a series of drive waveforms for the column shift operation and the same reference characters as those in FIG. 5 indicate the same pulses. When the discharge spot has been shifted to the discharge point f by the application of the shift pulses Vsh to the buses X1 and Y2, if the shift pulses Vsh are fed to the buses X1 and Y1, the discharge spot shifts to the discharge point g in the same manner as in the case of the abovesaid row shift operation. But, if the shift pulses Vsh are applied to the buses X1 and Y3, the discharge spot shifts to a discharge point g'. Then, upon application of the shift pulses Vsh to the buses X2 and Y3, the discharge spot shifts to a discharge point h'.

The combination of the discharge points with the buses supplied with the shift pulses in the column shift is as follows: f(X1, Y2), g'(X1, Y3) h'(X2, Y3), i'(X2, Y2), j'(X2, Y1), k'(X1, Y1) and l'(X1, Y2). That is, also in the column shift, the discharge spot shifts in meander pattern and at the moment when the discharge spot has reached the discharge point j', the column shift operation can be changed over to the row shift operation. This column shift is performed by the two-phase buses X1 and X2 and the three-phase ones Y1 to Y3. The discharge spot can be shifted in an oblique direction in the following manner. That is, when the discharge spot has shifted to the aforesaid discharge point j', the column shift operation is switched to the row shift operation to shift the discharge spot to discharge points k'' and l'' and when the discharge spot has reached the discharge point at the intersection of the electrodes x13 and y23, the row shift operation is changed over to the column shift operation and, thereafter, by performing the row and column shift operations alternately with each other in the abovesaid manner, the discharge spot can be shifted in an oblique direction.

By continuously applying pulses of a sustain voltage level to any one of the buses X1 to X3 and to any one of the buses Y1 to Y3, a stationary display can be provided, with picture elements having one to one correspondence to discharge points. Also, if pulses of the sustain voltage level are continuously fed to a selected one of the buses of one of the two substrates and to two selected ones of the buses of the other substrate, a stationary display can be provided, with one picture element corresponding to two discharge points. In this case, it is also possible to supply the pulses to the two buses alternately at every predetermined number of pulses. Since the abovesaid sustain voltage level is similar to the shift pulse level, a stationary display can be provided by continuous application of the shift pulses.

The above embodiment has been described in connection with the case of employing the combination of two sets of three-phase buses but it is also possible, of course, to adopt structures having many buses such as, for example, two sets of three-phase and four-phase buses or two sets of four-phase buses. In such a case, one or more of electrodes, which are formed to extend between electrodes alternately connected to two of the buses on both sides thereof, are interconnected in a manner to extend in a meander pattern so that they do not cross one another.

Figure 1:
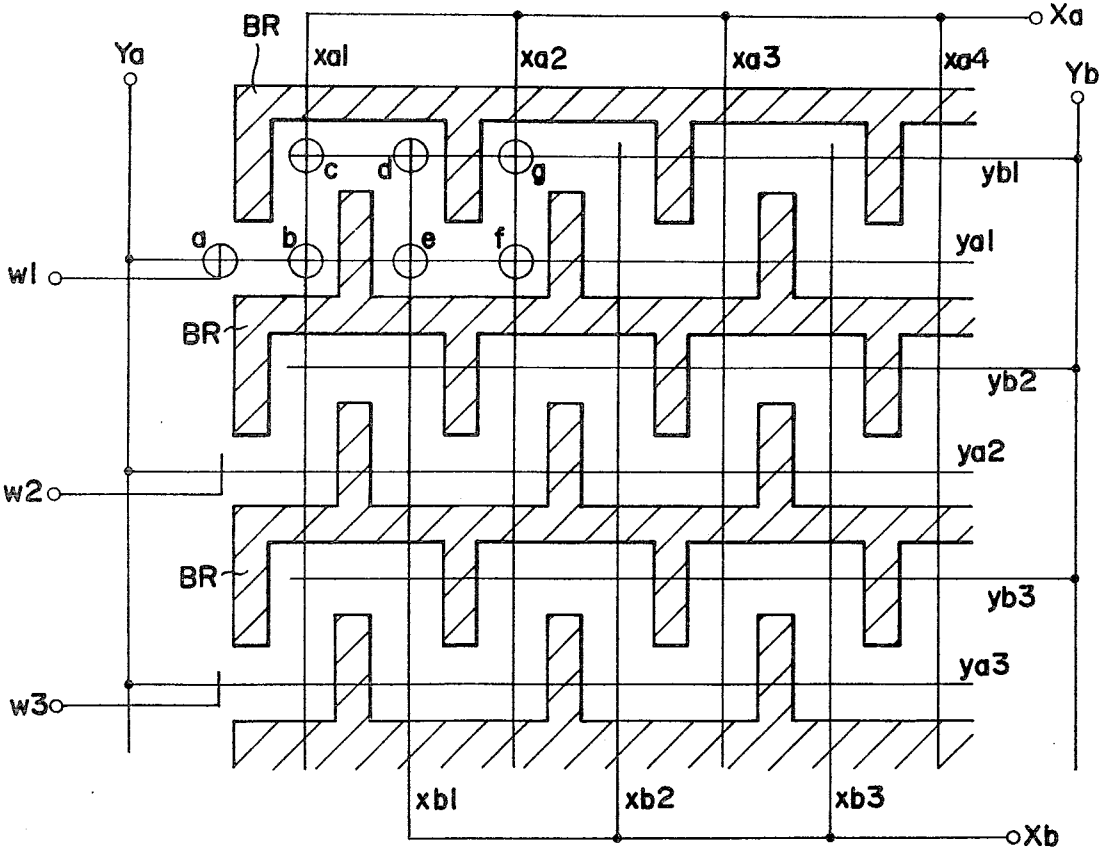
FIG. 1 PRIOR ART
FIG. 1 is a diagram explanatory of the electrode arrangement of a meander channel type self shift gas discharge panel as discussed above.
Figure 7:
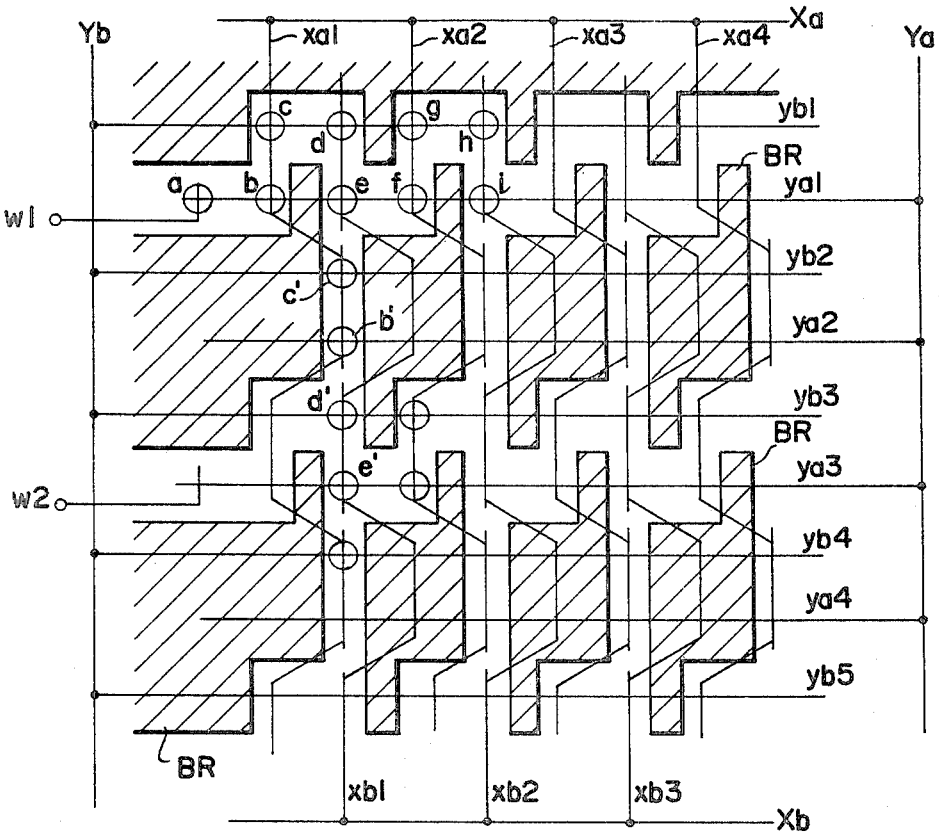
FIG. 7 is a schematic diagram explanatory of an electrode arrangement for use in another embodiment of this invention.

FIG. 7 shows an electrode arrangement for another embodiment of this invention, which employs two sets of two-phase buses. Row electrodes yaj and ybj are straight as is the case with the embodiment of FIG. 1 but column electrodes xai and xbi are formed with a repetitive displacement of an odd number of electrodes in the row direction (one electrode of displacement in the illustrated embodiment). Further, write electrodes wl (l=1, 2, 3, . . . ) are provided opposite odd-numbered ones of the electrodes connected to the bus Ya. The barriers BR are formed in the same pattern in the row direction as in the case of FIG. 1 in the row direction but portions of the barriers are selectively removed to provide straight column shift channels. Barriers are further formed on the even-numbered ones of the electrodes yaj and ybj connected to the buses Ya and Yb in the areas without column shift channels.

Figure 2:
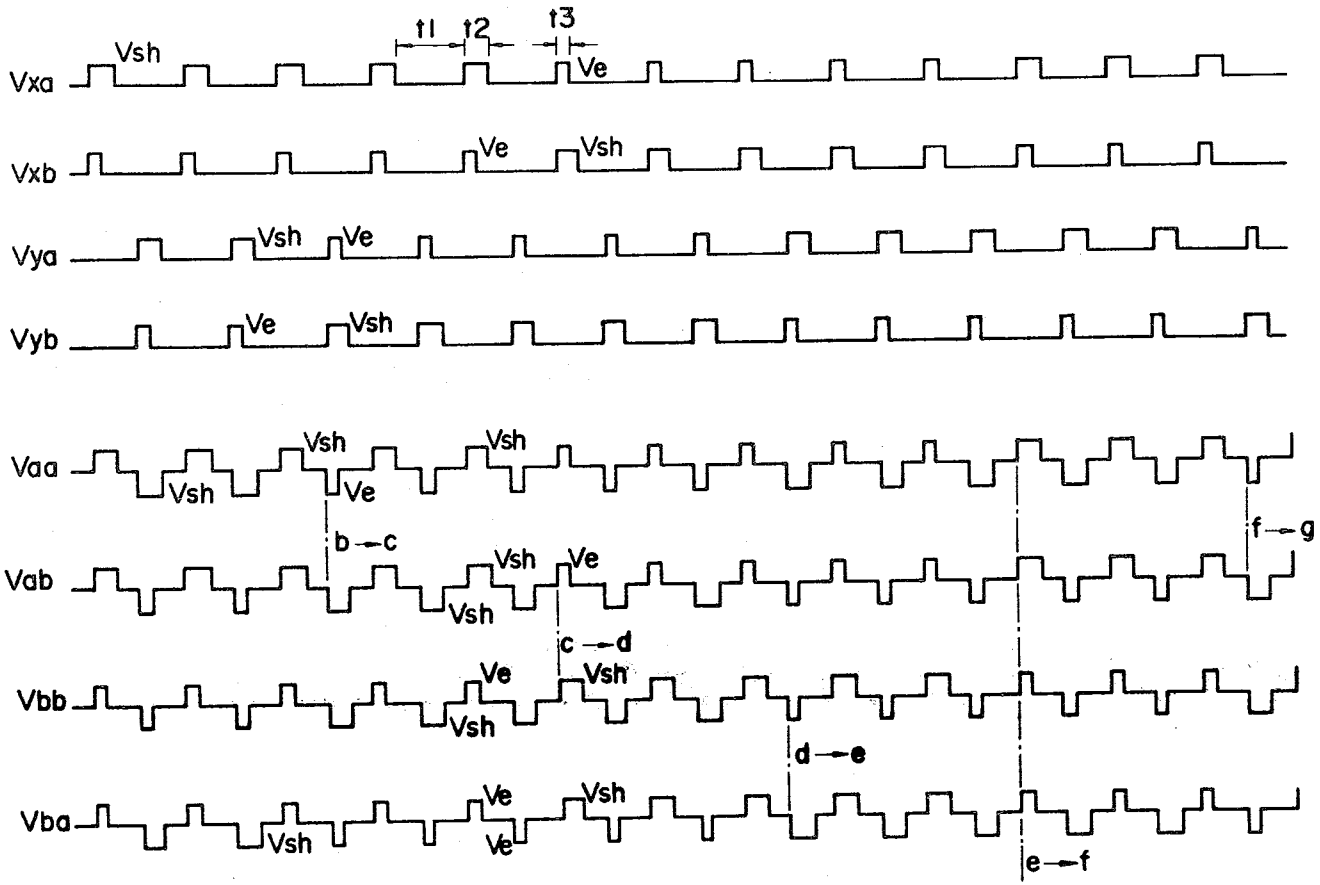
FIG. 2 PRIOR ART
FIG. 2 is a waveform diagram explanatory of drive waveforms as discussed.
Figure 3:
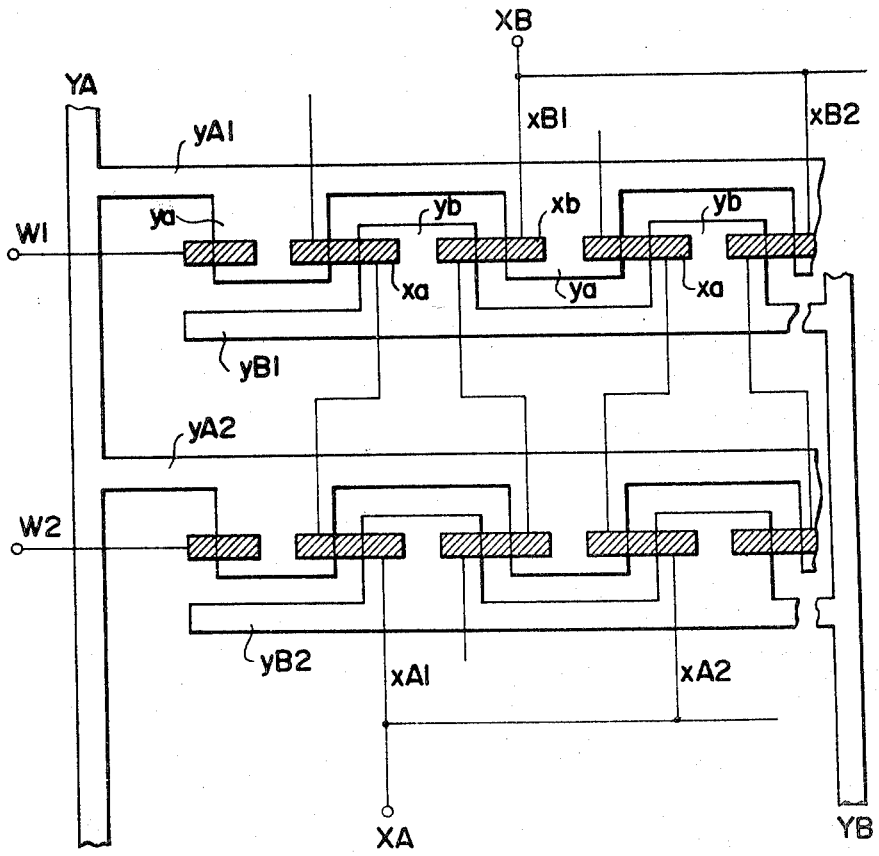
FIG. 3 PRIOR ART
FIG. 3 is a schematic diagram explanatory of an electrode arrangement of a meander electrode type self shift gas discharge panel as discussed above.

In the row shift operation, a discharge spot is shifted in meander pattern to discharge points a, b, c, d, e, f, . . . by the drive waveforms shown in FIG. 2. Assuming, for instance, that a discharge spot is produced at the discharge point e by the application of the shift pulses Vsh to the buses Xb and Ya, the discharge spot shifts to a discharge point c′ by the next application of the shift pulses Vsh to the buses Xa and Yb. Then, if the shift pulses Vsh are fed to the buses Xa and Ya, the discharge spot shifts to a discharge point b′. That is, the discharge spot is shifted in the column direction.

In such a column shift, a shift of the discharge spot, for example, from the discharge point e to c′ or from b′ to d′, can be readily achieved by extending one portion of each of the electrodes xal and xbl since there does not exist any electrode acting in common to the row and column directions. After the discharge spot has been shifted by the column shift to the discharge point d′, if the column shift is switched to the row shift operation, the discharge spot written by the write electrode w1 is shifted to the line of the write electrode w2 and if the column shift operation is continued, the discharge spot can be shifted to a desired line. That is, after characters of one line is written, all character lines can also be shifted in the column direction.

Figure 8:
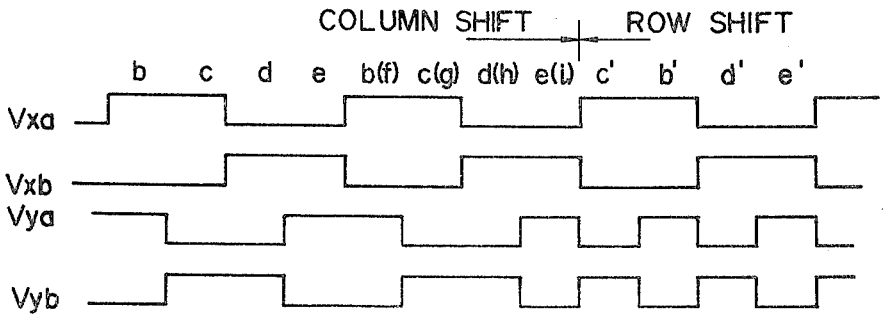
FIG. 8 is a waveform diagram showing, in the form of envelopes, shift pulses for the row and the column shift of the electrode arrangement of FIG. 7.

FIG. 8 illustrates, in the form of envelopes, the application of the shift pulses for the abovesaid row and column shift operations, reference characters b, c, d, . . . indicating the timings at which the discharge spot is shifted to the discharge points in FIG. 7. Namely, the shift pulses are applied to the buses in the order (Xa, Ya)-(Xa, Yb)-(Xb, Yb)-(Xb, Ya) in the row shift operation and in the order (Xb, Ya)-(Xa, Yb)-(Xa, Ya)-(Xb, Yb)-(Xb, Ya) in the column shift operation.

For a stationary display, pulse voltages are supplied to selected ones of the buses depending upon whether one picture element corresponds to one or more discharge points. In the case of displaying one picture element with one discharge point, the pulse voltages are continuously fed to either one of the buses Xa and Xb and either one of the buses Ya and Yb. In the case of displaying one picture element with a plurality of discharge points, for instance, two discharge points, the pulse voltages are successively applied to the buses Xa and Xb and either one of the buses Ya and Yb or either one of the buses Xa and Xb and the buses Ya and Yb, or the pulse voltages are supplied to the two buses Xa and Xb (or Ya and Yb) alternately at every predetermined number of pulses. This pulse voltage may be the same as the shift pulse voltage.

The same is true of the case of displaying one picture element with four discharge points, voltages being applied to selected ones of the buses so that discharge spots may be produced at the discharge points, for instance, b, c, d, and e in FIG. 7.

With the construction of the present embodiment, the discharge points c′ and b′ discharge to form a path for the vertical shift, but do not necessarily serve as discharge points for a display. Accordingly, the distance between these discharge points tends to increase.

For preventing degradation of the display quality resulting from the increased distance between the discharge points, it is desired to display one picture element with a plurality of discharge points, as described above. In the present embodiment, it is suitable to display one picture element with four discharge points.

Figure 9:
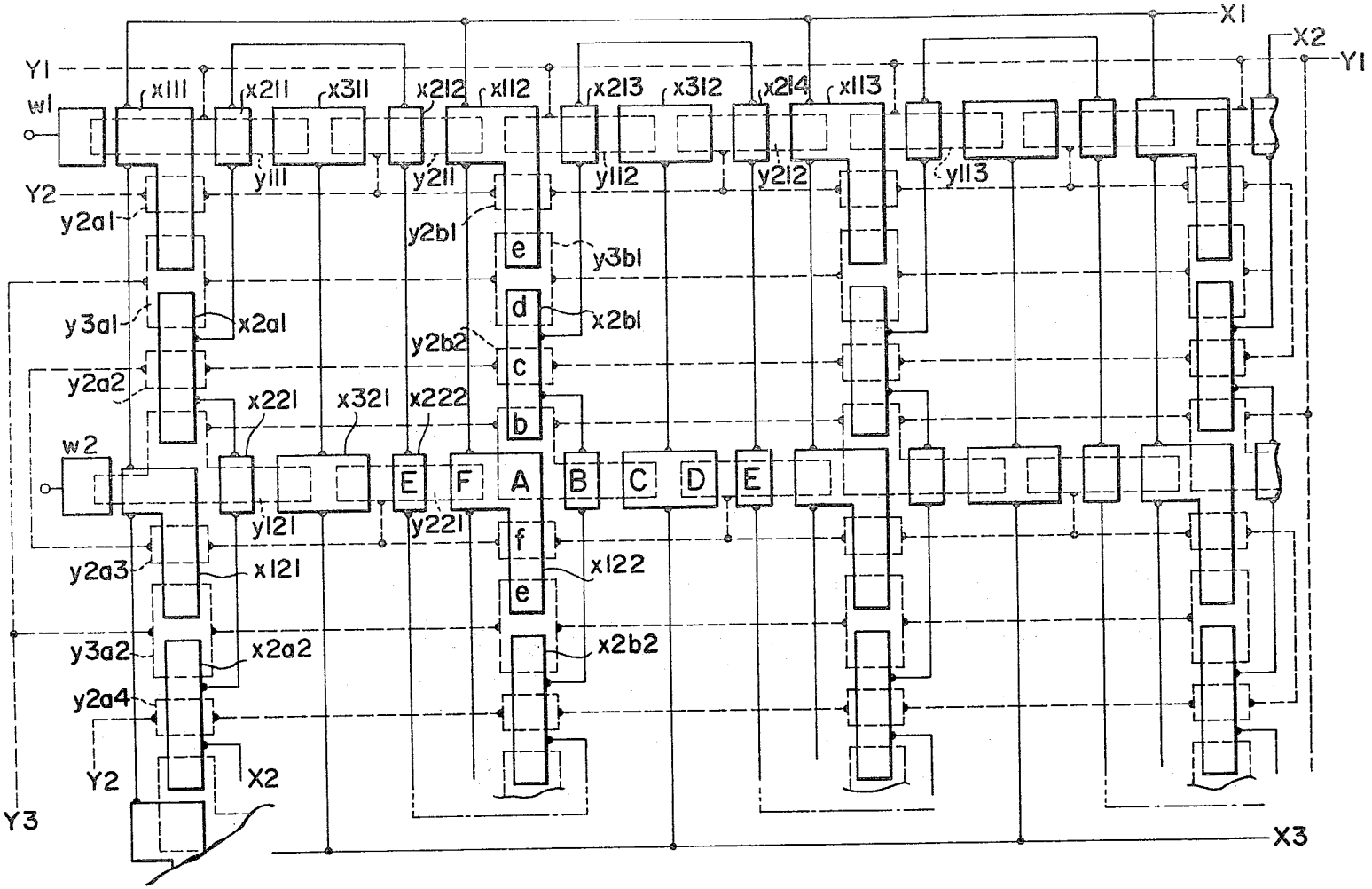
FIG. 9 is a schematic diagram explanatory of an electrode arrangement for use in another embodiment of this invention.

FIG. 9 shows an electrode arrangement in another embodiment of this invention, which is of the meander electrode type. On one substrate, there are disposed electrodes x1li to x3li and x2aj to x2nj respectively connected to three buses X1 to X3 and write electrodes wl (l, i, j,=1, 2, 3, . . . ), as indicated by the full lines. On the other substrate, there are disposed electrodes y1lk, y2lk, y2am to y2nm and y3am to y3nm (l, k, m=1, 2, 3, . . . ) respectively connected to three buses Y1 to Y3, as indicated by the broken lines. The abovesaid electrodes on the both substrates are respectively covered with dielectric layers, and disposed opposite each other with a discharge gas space defined therebetween.

The order of arrangement of the electrodes in the row direction is x1l1, x2l1, x3l1, x2l2, x1l2, x2l3, x3l2, . . . on one substrate, and y1l1, y2l1, y1l2, y2l2, . . . on the other substrate. The order of arrangement of the electrodes in the column direction is, for example, x111, x2a1, x121, x2a2, . . . on one substrate and y111, y2a1, y3a1, y2a2, y121, y2a3, y3a2, y2a4, . . . on the other substrate. To the buses X1 and X3 are respectively connected the electrodes x1li and x3li through conductors in the column direction but to the bus X2 are connected the electrodes x2li in meander pattern through conductors, including the electrodes x2aj to x2nj. Accordingly, although the three buses X1 to X3 are provided, no cross-over parts are formed. Further, the buses Y1 to Y3 and the electrodes y1lk, y2lk, y2am to y2nm and y3am to y3nm are interconnected in a relation similar to the relationship of connections of the buses X1 to X3 to the electrodes x1i to x3i and x2aj to x2nj except as rotated through 90°, providing the structure with no cross-over parts.

Figure 10:
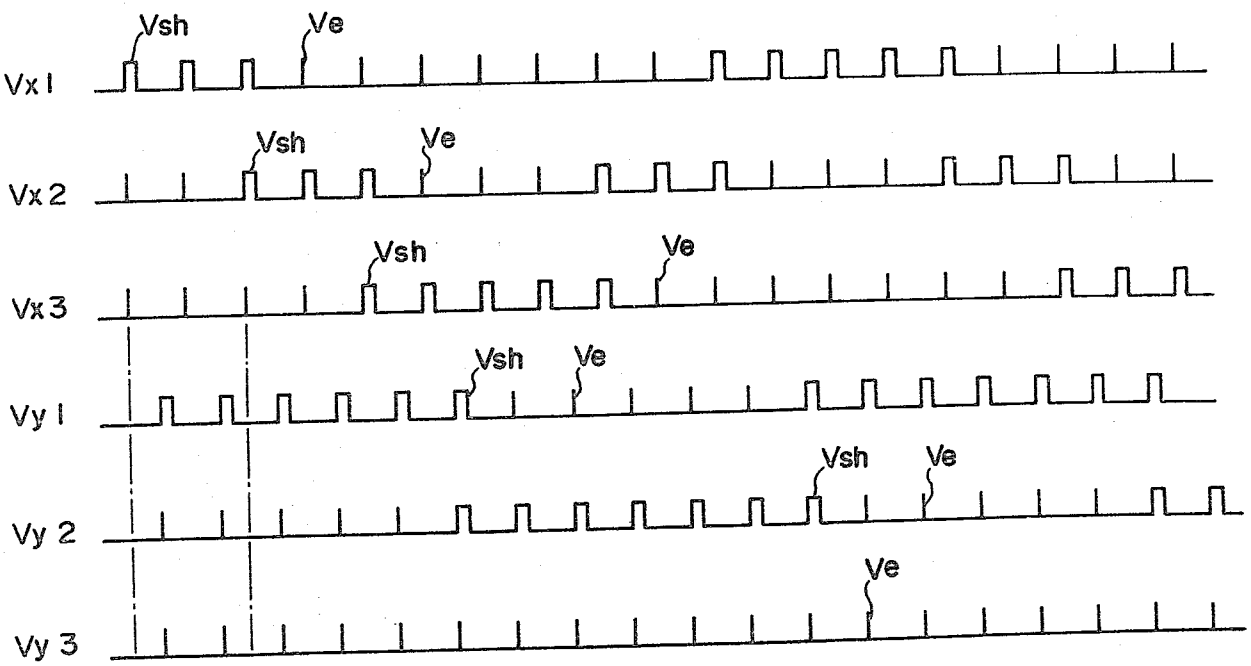
FIG. 10 is a waveform diagram showing an example of drive waveforms for the row shift in the electrode arrangement of FIG. 9.

FIG. 10 illustrates an example of a series of drive waveforms for the row shift operation. Reference characters Vx1 to Vx3 and Vy1 to Vy3 show pulse voltages which are supplied to the buses X1 to X3 and Y1 to Y3, respectively; Vsh indicates shift pulses; and Ve indicates erase pulses. Also, in this embodiment, it is possible to employ such a drive waveform that an overlap pulse is applied at the timing for shifting a discharge spot, though not shown.

For example, in the case of a write pulse being applied to the write electrode w1, when the shift pulses Vsh are fed to the buses X1 and Y1, a discharge spot is produced between the electrodes x111 and y111 by the application of the shift pulses to the buses X1 and Y1 and the discharge spot is sequentially shifted to discharge points between the electrodes x211 and y111, x311 and y111, x311 and y211, and x212 and y211 be sequentially applying the shift pulses Vsh to the buses X2 and Y1, X3 and Y1, X3 and Y2, and X2 and Y2. That is, the shift pulses Vsh are supplied to the buses in the order (X1, Y1)-(X2, Y1)-(X3, Y1)-(X3, Y2)-(X2, Y2)-(X1, Y2)-(x1, Y1)- . . . , by which the discharge spot is shifted in the row direction. Since the erase pulse Ve is applied to each discharge point from which the discharge spot has shifted, the wall charge at the discharge point is erased.

Figure 11:
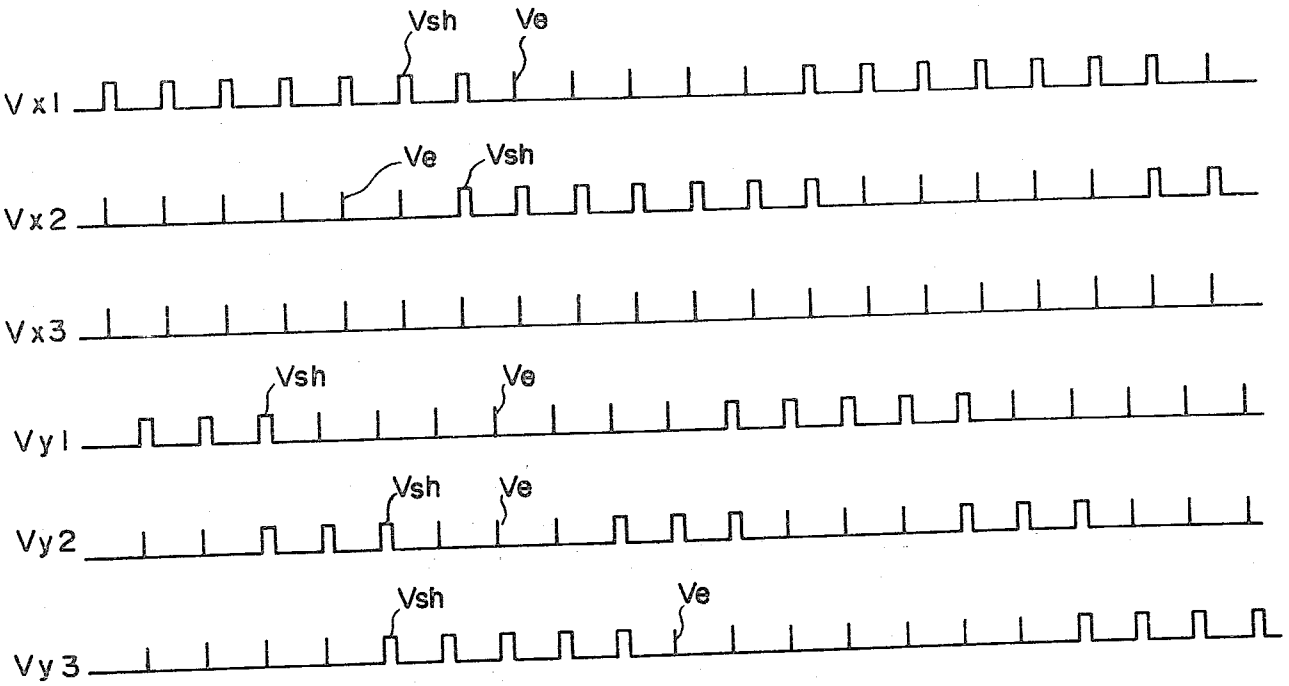
FIG. 11 is a waveform diagram illustrating an example of drive waveforms for the column shift in the electrode arrangement.

FIG. 11 is explanatory of an example of a series of drive waveforms for the column shift operation. Reference characters Vx1 to Vx3 and Vy1 to Vy3 show pulse voltages which are fed to the buses X1 to X3 and Y1 to Y3, respectively. In this case, after the discharge spot has shifted to the discharge point between the electrodes x1 i and y1 k, that is, after the shift pulses Vsh have been applied to the buses X1 and Y2, the shift pulses Vsh are applied to the buses X1 and Y2. For instance, applying the shift pulses Vsh to the buses X1 and Y2 after the discharge spot has shifted to the discharge point between the electrodes x112 and y112, the discharge spot shifts to the discharge point between the electrodes x112 and y2b1. Then, if the shift pulses Vsh are fed to the buses X1 and Y3, the discharge spot shifts to the discharge point between the electrodes x112 and y3b1.

In the column shift, the shift pulses Vsh are applied to the buses in the order (X1. Y1)-(X1, Y2)-(x1, Y3)-(X2, Y3)-(X2, Y2)-(X2, Y1)-(X1, Y1)- . . . .

As seen from FIGS. 10 and 11, in the present embodiment, during the row shift operation, the shift pulses Vsh are applied to the buses X1 to X3, Y1 and Y2 in the predetermined order, but the bus Y3 is left idle. Further, during the column shift operation, the shift pulses Vsh are supplied to the buses X1, X2 and Y1 to Y3, but the bus X3 is left idle.

In the case of a stationary display, sustain voltage pulses are applied to the buses, for example, X1 and X2 alternately with a predetermined period and to the bus Y1 continuously, by which discharge spots are produced alternately between the electrodes x1li and y1lk and between x2li and y1lk, providing a display of the content written by the write electrode wl. The sustain voltage pulse may be the same as the shift pulse Vsh, so that a pulse generator circuit can be used in common to the shift operation and the stationary display operation, as is the case with the prior art.

The drive waveforms such as described above can be easily obtained by changing the logic structure of a drive circuit for the self shift type gas discharge panel already proposed, and it is also possible, of course, to employ other waveforms than those shown in FIGS. 10 and 11. The drive waveforms depicted in FIGS. 5 and 6 and those in FIGS. 10 and 11 are substantially identical with each other except that the shift pulses Vsh are supplied in an overlapping relation in the case of the latter.

In FIG. 9, for convenience of illustration, the electrodes on the both substrates are shown to be different in size from each other but these electrodes can be formed to be of the same size. Further, the conductors, through which the electrodes forming discharge points are connected to the buses, cross each other on opposing substrates, but discharge characteristics differ with the size of their opposed areas. Where the opposed areas are small, there is the tendency that the operating voltages of the opposing intersecting parts of the conductors become high, and consequently discharge spots are produced only at the larger areas of the electrode opposing parts, i.e. at the discharge points, and no discharge spots are produced at the opposing parts of the intersecting conductors. The operation margin can be further increased by other construction to prevent generation of discharge spots at the opposing parts of the intersecting conductors, for example, by covering each opposing part of the conductors with a thicker dielectric layer than those covering the other parts. Also, the number of buses used can be increased.

Figure 12:
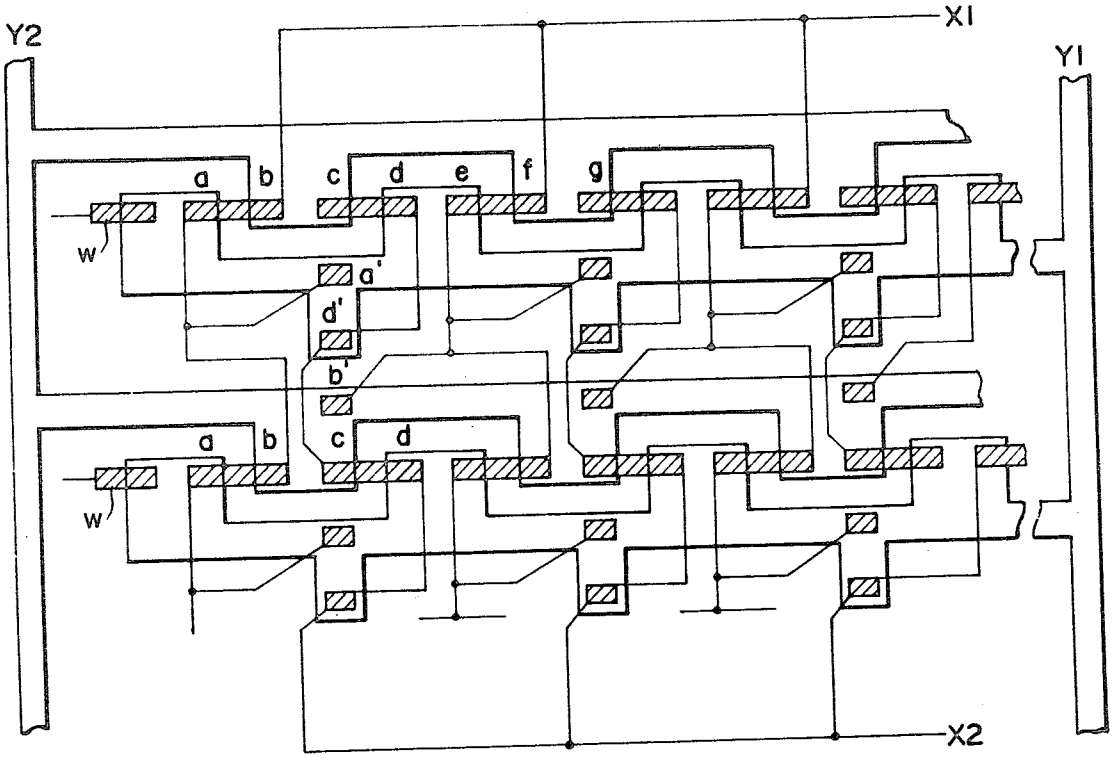
FIGS. 12 and 13 are schematic diagrams explanatory of electrode arrangements for use in other embodiments of this invention.

FIG. 12 illustrates an electrode arrangement employed in another embodiment of this invention, in which the row shift is an ordinary one but the column shift is a combination of a hopping shift with the ordinary one. Reference characters X1 and X2 indicate buses of one substrate; Y1 and Y2 designate buses of the other substrate; w identifies write electrodes; and a, b, c, d, e, f, g, . . . and a', de, and b' denote discharge points formed at the opposing points of electrodes, namely unit discharge regions.

The ordinary shift mentioned above means that adjacent discharge points in the direction of shift of a discharge spot are formed with a common electrode extending in the direction of shift of the discharge spot and discrete electrodes disposed opposite the common electrode and that the discharge spot is shifted by applying shift pulses to the discrete electrodes one after another. The shift of the discharge spot in each of the foregoing embodiments is the ordinary shift. The hopping shift herein mentioned implies that adjacent discharge points in the direction of shift of a discharge spot are respectively formed with intersections of opposed discrete electrodes and that the discharge spot is shifted by applying shift pulses to the pairs of opposed electrodes one pair after another. In the hopping shift, since no common electrode is provided in the direction of shift of the discharge spot, plasma coupling may be inadequate in some cases. But the coupling can be enhanced by extending the end portion of each electrode in the direction of shift of the discharge spot.

The correspondence of the discharge points to the buses supplied with the shift pulses in the row shift is as follows: a(X1, Y1), b(X1, Y2), c(X2, Y2), d(X2, Y1), e(X1, Y1), f(X1, Y2), g(X2, Y2), . . . . Namely, in the row shift, the shift pulses are respectively applied in the order in which they are fed to the four discharge points a to d.

In the column shift, after a discharge spot has shifted to the discharge point c (g), the shift pulses are fed to the buses in the order a'(X1, Y1)-d'(X2, Y1)-b'(X1, Y2)-c(X2, Y2)- . . . . The shift of the discharge spot from the discharge point c to a' and d' to b' is the hopping shift and the shift from a' to d' and b' to c is the ordinary shift.

In the column shift, assume that when the discharge spot is to be shifted from, for example, the discharge point c to a', the discharge spot is erroneously shifted by some cause to the discharge point a or e which is supplied with the shift pulse in the same manner as the discharge point a'. Since the shift pulses are next applied to the discharge points d' and d, the discharge spot normally shifts from the discharge point a' to d' in the column direction, but now assume the discharge spot is shifted in the wrong direction from the discharge point e to d in the row direction. With these pulses a discharge spot erroneously shifted to the discharge point a disappears. Then, since the next shift pulses are supplied to the discharge points b' and b, the discharge spot is normally shifted from the discharge point d' to b' in the column direction but, in the row direction, since the discharge point c is interposed between d and b, the discharge spot is difficult to shift, and disappears. Thus, even if a discharge spot is shifted in a wrong direction, this faulty discharge spot disappears in the course of subsequent shift operations, so that the shift operation margin can be increased.

Figure 13:
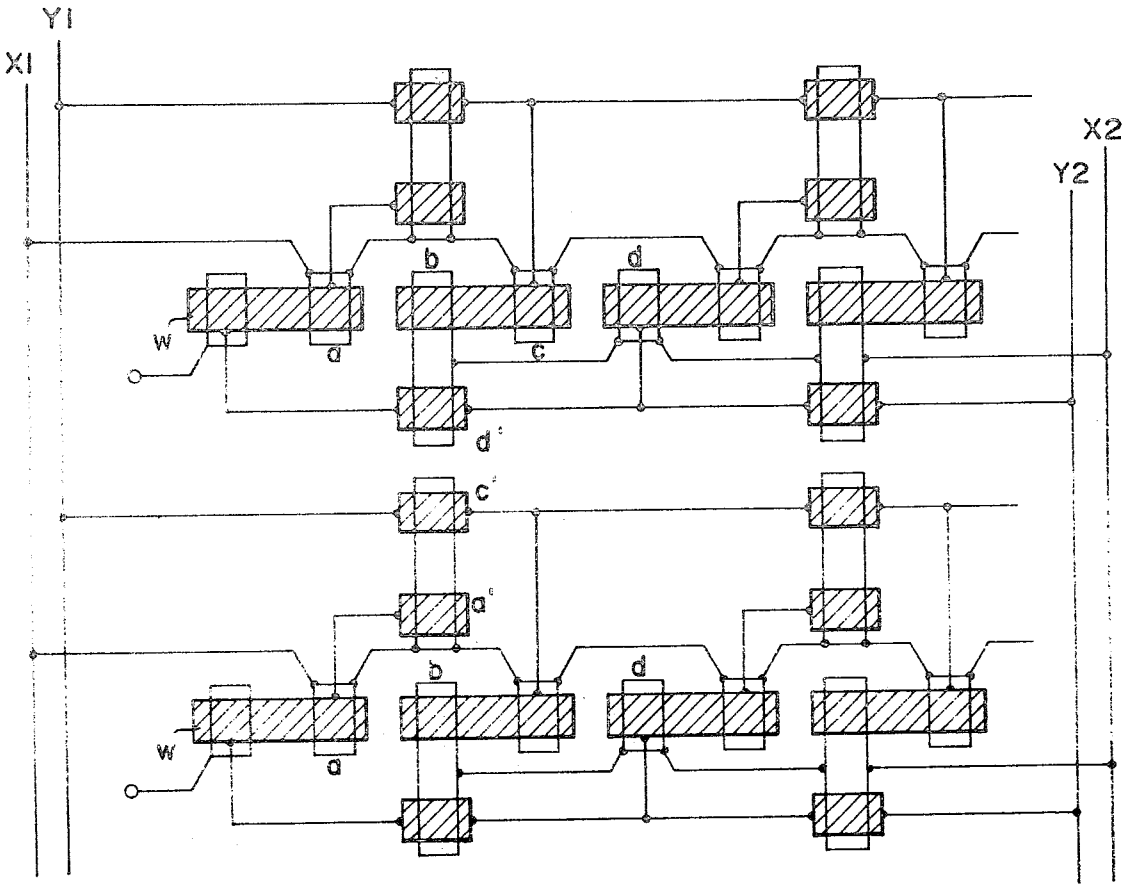

FIG. 13 shows another embodiment of this invention in which the row and column shifts are achieved with a combination of the hopping shift and the ordinary shift. The electrodes connected to buses X1 and X2 on one of two substrates are each short in the row direction but long in the column direction and the hatched electrodes connected to buses Y1 and Y2 on the other substrate are long in the row direction but short in the column direction. Reference character w indicates write electrodes.

In the row shift, the combination of discharge points a, b, c and d with the buses supplied with the shift pulses is a(X1, Y2), b(X2, Y1), c(X1, Y1) and d(X2, Y2). In the column shift, the combination is b(X2, Y1), d'(X2, Y2), c'(X1, Y1) and a'(X1, Y2). The shift of the discharge spot from the discharge point a to b, c to d and d' to c', a' to b is the hopping shift.

In the above embodiments shown in FIGS. 12 and 13, two buses are provided on each of the two substrates and a two-dimensional shift is made possible without forming any crossover parts. But this invention is also applicable to the case where three or more buses are provided on one or both of the substrates and the order of application of the shift pulses can be easily set by a logical circuit. Further, since the electrode configurations are shown so that the electrodes on each substrate may be distinguished from those on the other substrate, it is possible, of course, to employ various electrode configurations other than the illustrated ones.

Figure 14:
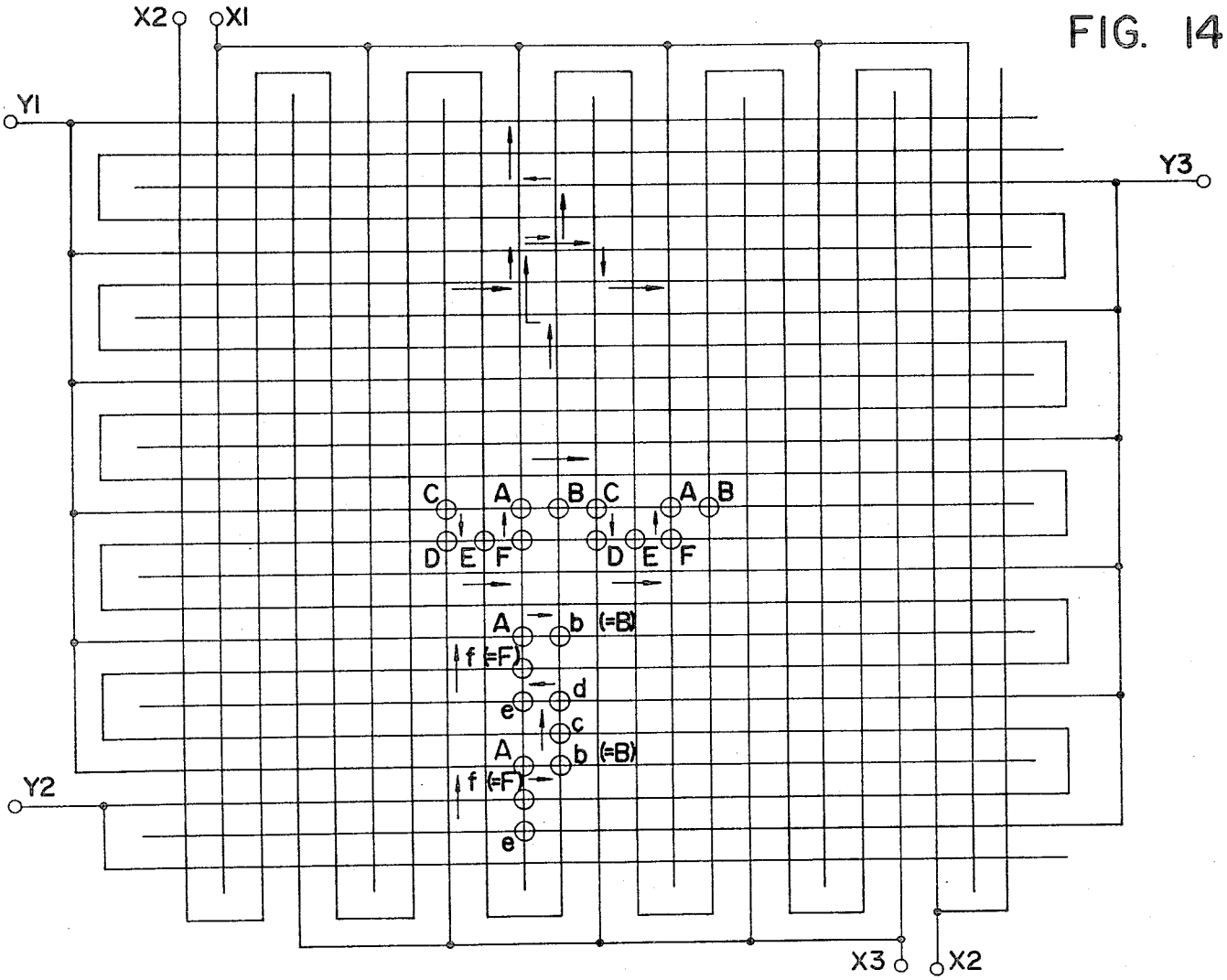
FIG. 14 is a schematic diagram explanatory of a discharge spot shift operation, illustrating the electrode arrangement of FIG. 9 in simplified form.

FIG. 14 illustrates, in a simplified form, the electrode arrangement of FIG. 9, the discharge points formed in the row direction being identified by A to F and those in the column direction by b to f. This electrode arrangement is of the meander channel type. The shift channels extend also in a meander type pattern as indicated by the arrows. Turning points from the row to the column shift and vice versa are at the discharge points A.

The discharge points A are respectively formed between the electrodes connected to the buses X1 and Y1. The discharge points B and b, each adjacent to A, are respectively formed between electrodes connected to the same buses X2 and Y1, and the discharge points F and f are respectively formed between electrodes connected to the same buses X1 and Y2. Accordingly, when shifted from the discharge point A, a discharge spot is shifted to both of the discharge points B and b or to F and f at the same time. In this case, since the two discharge points B and b or F and f are close to each other, the discharge spots at these discharge points greatly repel each other and either one of them may be erased due to a slight difference between the characteristics of the discharge points in some cases. In such cases, if the discharge spot at the discharge point in the shift direction is erased, one portion of the written content is lost.

Figure 15:
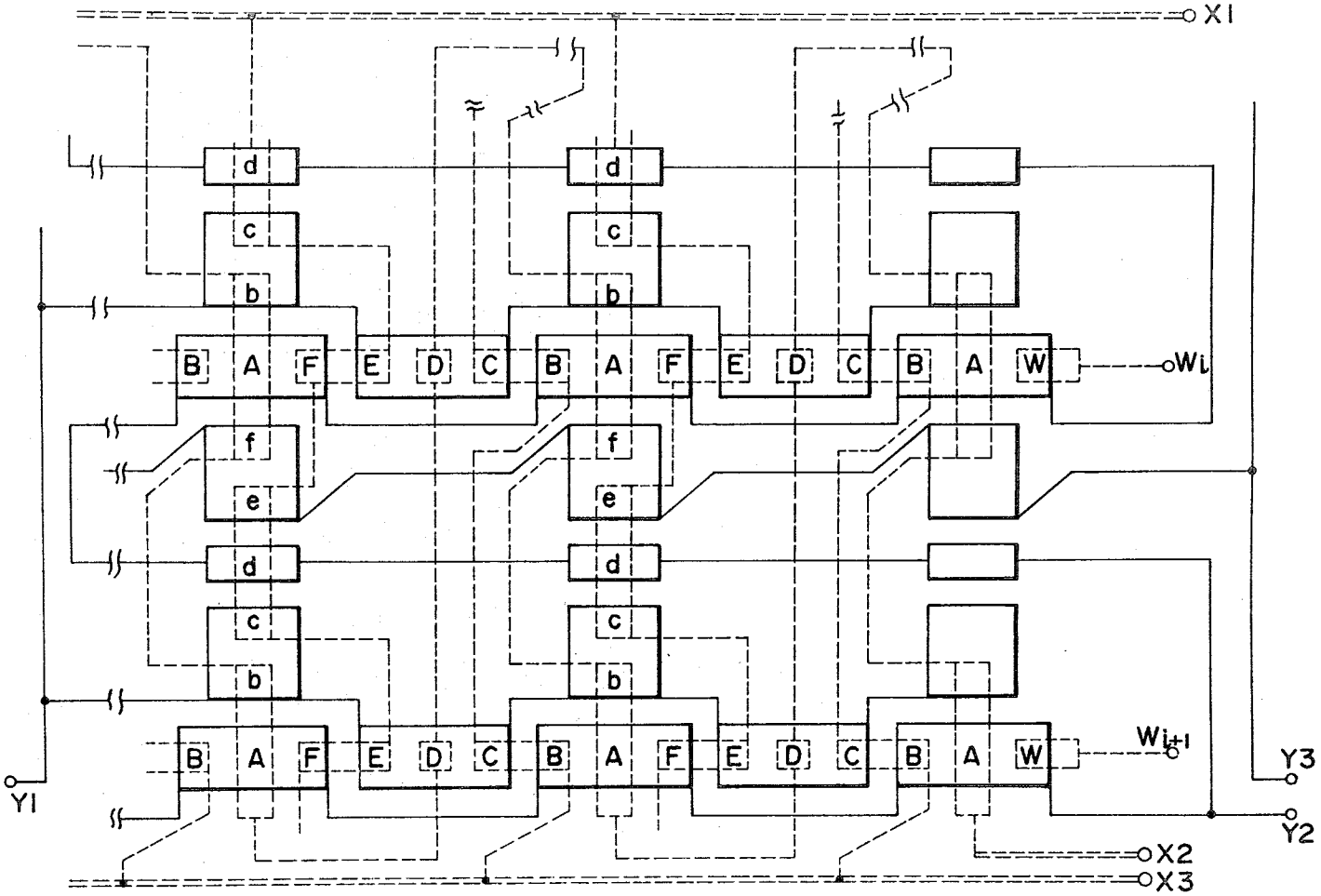
FIG. 15 is a schematic diagram showing an electrode arrangement for use in another embodiment of this invention.

FIG. 15 shows an electrode arrangement used in another embodiment of this invention which is designed to ensure shifting of discharge spots from the discharge points at which the row and column shifts are switched to each other as described above. The electrodes connected to the buses X1 to X3 and conductors therefor are indicated by the broken lines, and the electrodes connected to the buses Y1 to Y3 and conductors therefor are indicated by the full lines. In the present embodiment, the discharge points A, which are the abovesaid turning points, are formed respectively between the electrodes connected to the buses X2 and Y2, i.e. the conductors of zigzag configuration. The discharge points B, b, F and f respectively adjoining F are formed between the electrodes connected to different combinations of buses. The combination of the discharge points with the buses is as follows: B(X3, Y2), b(X2, Y1), F(X1, Y2) and f(X2, Y3).

Accordingly, in the case of shifting a discharge spot in the row direction to the discharge points E, F, A, B, C and D one after another, if it is assumed that the discharge spot is produced at the discharge point F by the application of shift pulses to the buses X1 and Y2, the discharge spot is shifted to the discharge point A by the next application of of shift pulse to the buses X2 and Y2, and then shifted only to the discharge point B by the subsequent application of shift pulses to the buses X3 and Y2. In other words, there are no possibilities of the discharge spot simultaneously shifting to two discharge points, as described previously in connection with FIG. 14.

In the case of shifting a discharge spot in the column direction to the discharge points e, f, A, b, c and d one after another, if it is assumed that the discharge spot is produced at the discharge point f by the application of shift pulses to the buses X2 and Y3, the discharge spot is shifted to the discharge point A by the next application of shift pulses to the buses X2 and Y2, and then shifted only to the discharge point b by the subsequent application of shift pulses to the buses X2 and Y1.

Figure 16:
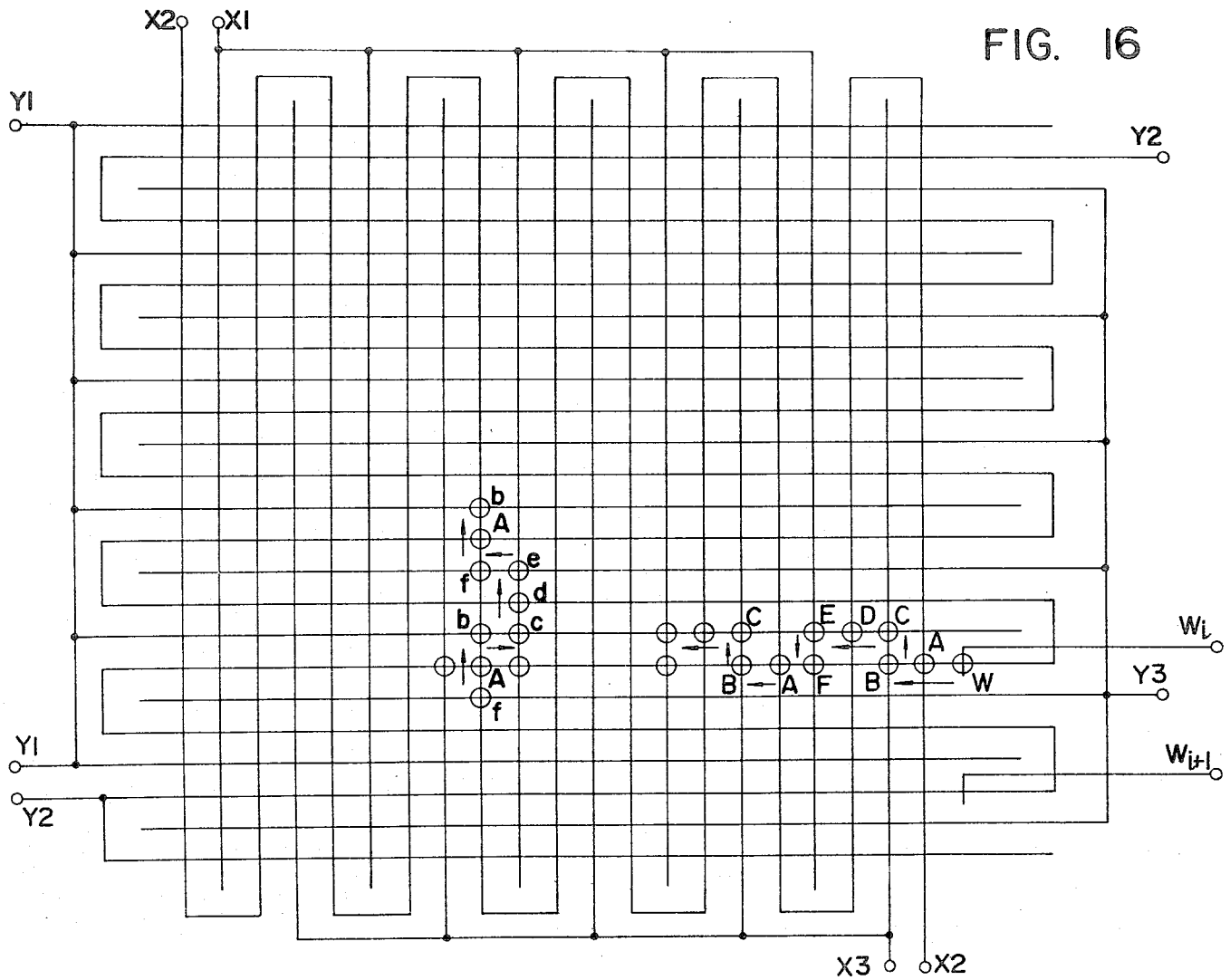
FIG. 16 is a schematic diagram illustrating the electrode arrangement of FIG. 15 in simplified form.

FIG. 16 is a schematic diagram, similar to FIG. 14, illustrating a simplified form of the electrode arrangement depicted in FIG. 15. The discharge points A, at which the discharge spot is switched from the row shift to the column one and vice versa, are formed at the intersections of the meandering electrodes, i.e. the buses X2 and Y2.

Figure 17:
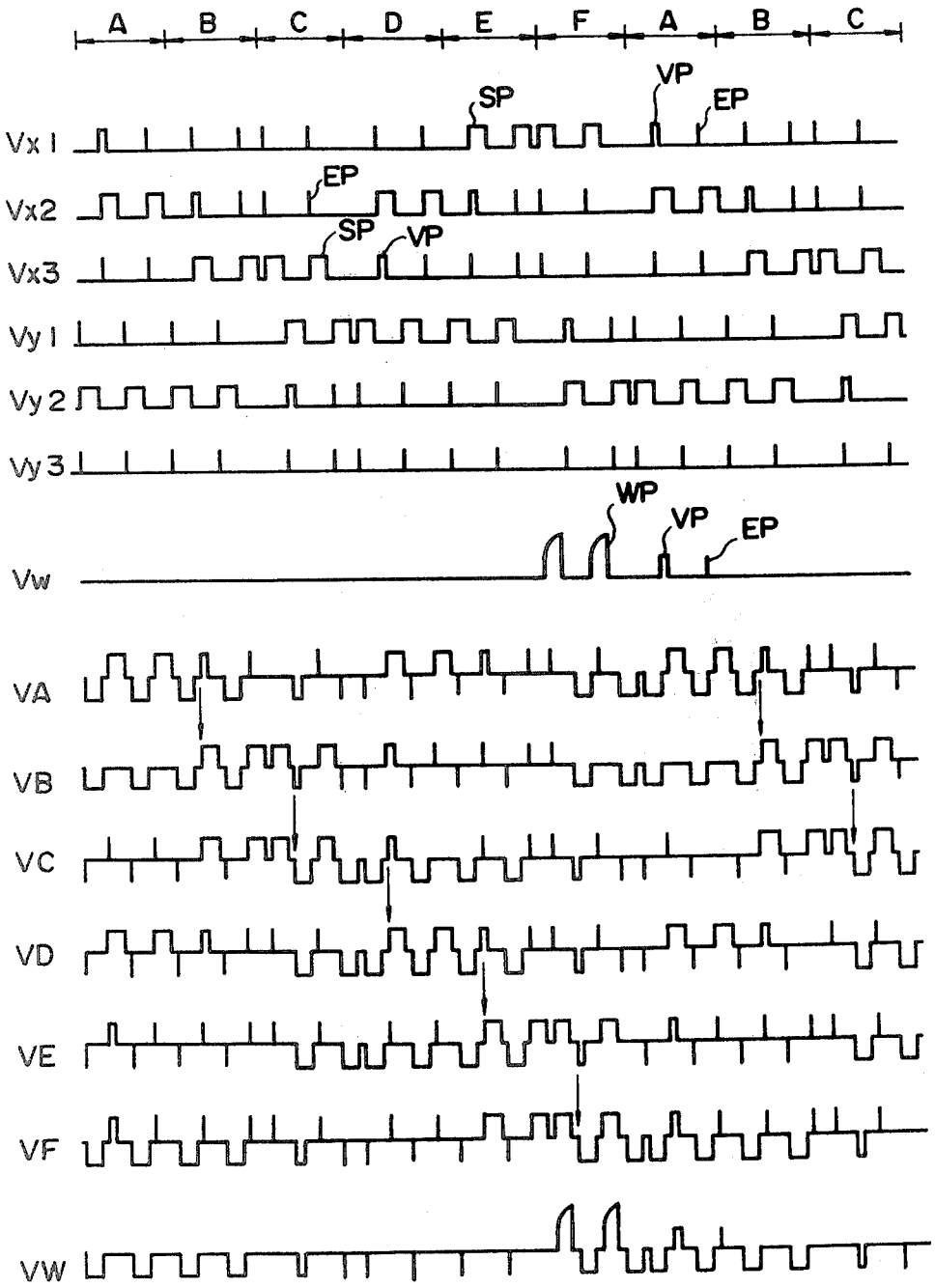
FIG. 17 is a waveform diagram explanatory of drive waveforms for the row shift in the electrode arrangement of FIGS. 15 and 16.

FIG. 17 is a waveform diagram showing an example of a series of drive waveforms. In the case of the row shift, the buses X1 to X3 and Y1 to Y3 are respectively supplied with pulses voltages Vx1 to Vx3 and Vy1 to Vy3, each composed of a shift pulse SP, an overlap pulse VP and an erase pulse EP. For the row shift, the bus Y3 is supplied with the erase pulse EP only. Reference character Vw shows the voltage waveform which is applied to a write electrode. At the timing that the discharge spot is shifted to the discharge point F, a write pulse WP is applied and then the overlap pulse VP is applied to shift the discharge spot to the discharge point A and, thereafter, the erase pulse EP is applied.

Reference characters VA to VF and VW show pulse voltage waveforms which result across the discharge points A to F and the write discharge point, respectively. The arrows indicate the shift timings of the discharge spot. Reference characters A to F at the top of FIG. 17 indicate the periods in which the discharge spot is present at the discharge points A to F, respectively.

Figure 18:
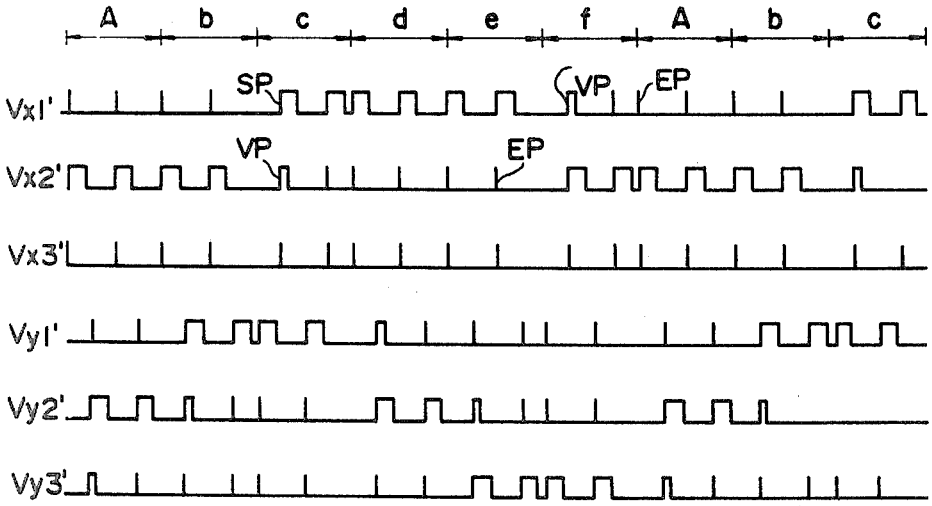
FIG. 18 is a waveform diagram explanatory of drive waveforms for the column shift in the electrode arrangement of FIGS. 15 and 16.

In FIG. 18 Vx1′ to Vx3′ and Vy1′ to Vy3′ show pulse voltage waveforms which are fed to the buses X1 to X3 and Y1 to Y3, respectively, in the case of the column shift. The bus X3 is supplied with the erase pulse EP only. A and b to f indicate the periods in which the discharge spot is present at the discharge points A and b to f, respectively. The pulse voltages which are fed to the discharge points A and b to f in the above case have waveforms similar to those VA to VF depicted in FIG. 17.

In the above embodiment, information is written at the timing at which the discharge spot is shifted to the discharge point F, but it is also possible to write information at the timing of shifting the discharge spot to some other discharge point. For instance, in the case of writing information at the timing of shifting the discharge spot to the discharge point C, the arrangement is made such that the discharge point D may be adjacent a write discharge point W and the abovesaid turning point is selected to be the discharge point A formed at the intersection of the buses X2 and Y2 of the zigzag configurations, as is the case with the above embodiment.

Figure 19:
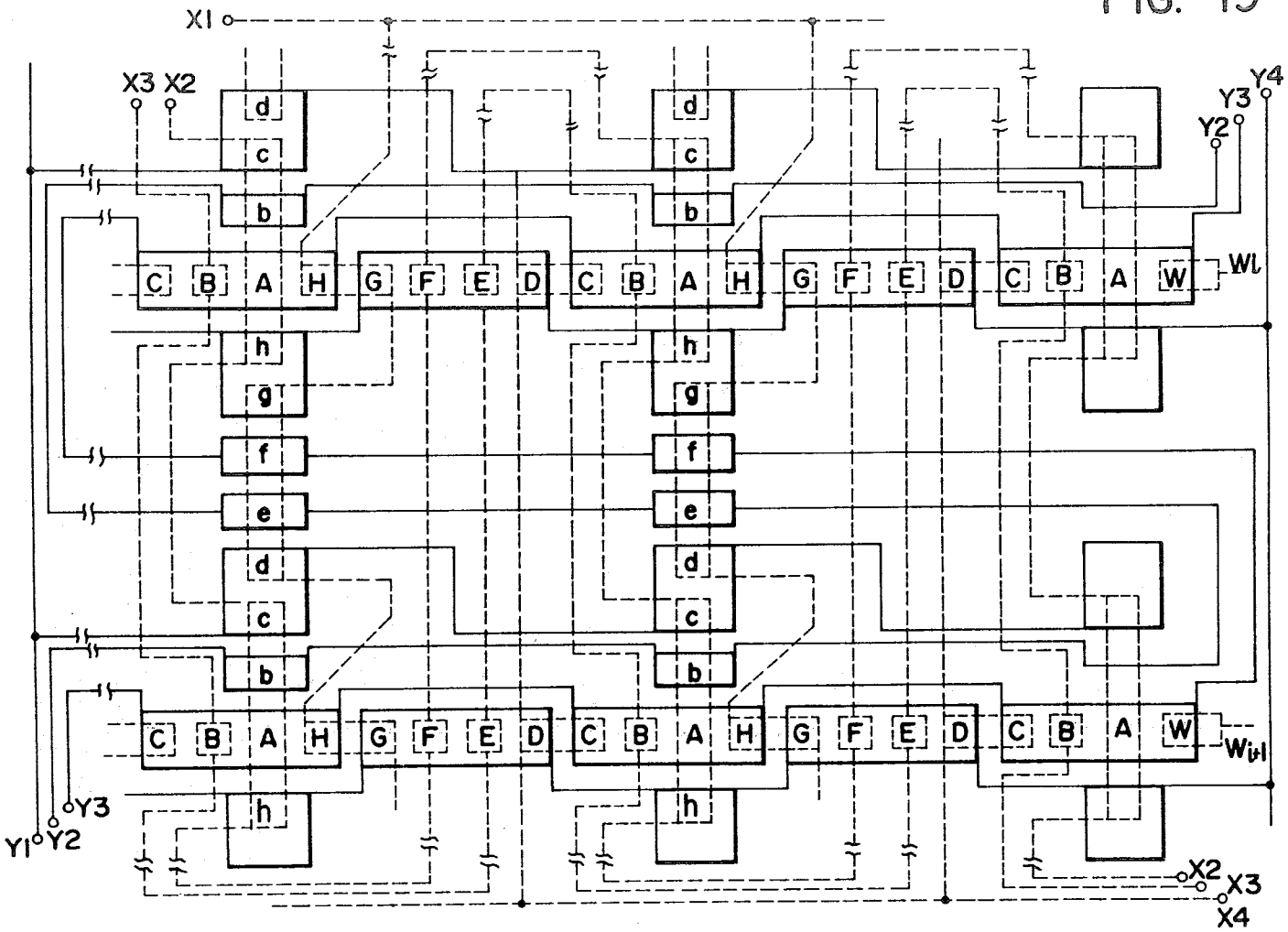
FIG. 19 is a schematic diagram explanatory of an electrode arrangement for use in another embodiment of this invention.

FIG. 19 is a diagram explanatory of an arrangement adopted in another embodiment of this invention, in which four-phase buses X1 to X4 and Y1 to Y4 are provided on a pair of substrates, respectively. Also, in this embodiment, the intersection of an array of the discharge points A to H in the row direction with an array of the discharge points A and b to h, that is, the abovesaid turning point, is the discharge point A formed between electrodes connected to the meander pattern buses X2 and Y2, respectively. Although four discharge points B, b, H and h adjoin the turning point, a discharge spot is shifted only to the discharge point adjacent A in the shift direction.

Figure 20:
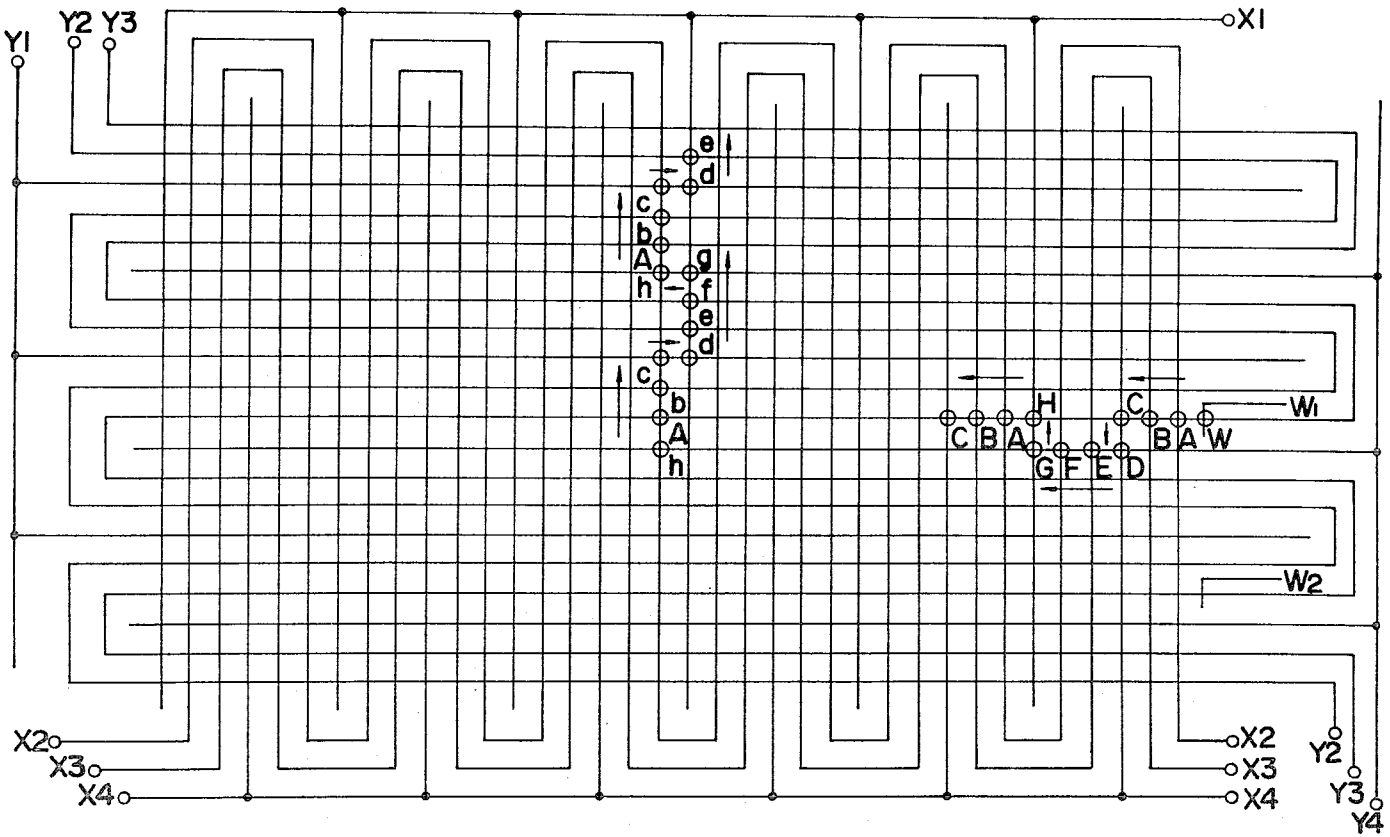
FIG. 20 is a schematic diagram showing the electrode arrangement of FIG. 19 in simplified form.

FIG. 20 is a schematic diagram, similar to FIG. 14, illustrating, in a simplified form, the electrode arrangement depicted in FIG. 19. Adjacent a write discharge point W, the discharge point A is disposed which is the intersection of the buses X2 and Y3 and, by selecting shift pulses applied to the buses X1 to X4 and Y1 to Y4, a row or column shift can be achieved and the turning point in this case is the discharge point A.

Figure 21:
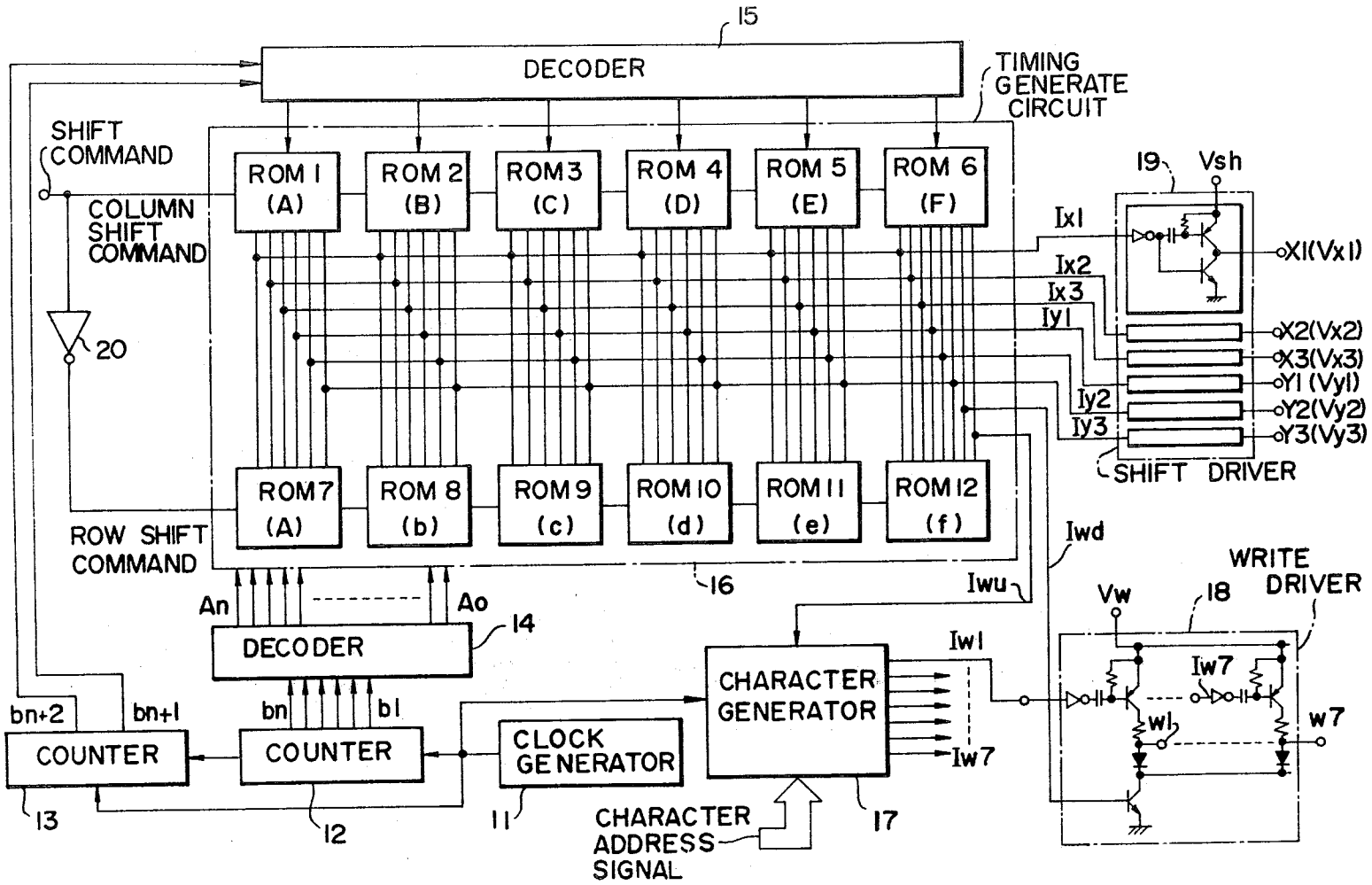
FIG. 21 is a block diagram illustrating an example of a drive circuit for generating the pulse voltages of the drive waveforms depicted in FIGS. 17 and 18.

FIG. 21 is a block diagram showing a drive circuit for generating pulse voltages of the drive waveforms depicted in FIGS. 17 and 18. Clock pulses emanating from a clock generator 11 are counted by counters 12 and 13 and the count contents b1 to bn of the counter 12 are decoded by a decoder 14, thereafter being applied as address signals A0 to An to a timing generate circuit 16. The count contents bn+1 and bn+2 of the counter 13 are decoded by a decoder 15 and then applied to the timing generate circuit 16. The timing generate circuit 16 is provided with six read-only memories ROM1 to ROM6 having stored therein drive timings of six steps in the row shift and six read-only memories ROM7 to ROM12 having stored therein drive timings of six steps in the column shift. Reference characters (A) to (F) and (Å) to (f) in the read-only memories ROM1 to ROM6 and ROM7 to ROM12 indicate that they have stored therein the timings of pulse voltages to be generated in the periods A to F and A to f in FIGS. 17 and 18.

When a shift instruction is "1", it is a column shift instruction and when it is "0", the output from an inverter 20 becomes "1" to provide a row shift instruction. A shift driver 19 operates with timing signals Ix1 to Ix3 and Iy1 to Iy3 read out of the read-only memories ROM1 to ROM6 and ROM7 to ROM12, supplying the buses X1 to X3 and Y1 to Y3 with the pulse voltages Vx1 to Vx3, Vy1 to Vy3 and Vx1′ to Vx3′, Vy1′ to Vy3′ shown in FIGS. 17 and 18.

A character generator 17 supplies a write driver 18 with signals IW1 to IW7 corresponding to character address signals, respectively. The signals IW1 to IW7 are outputted at the timings defined by the clock pulses and a timing signal Iwu derived from the read-only memory ROM6 or ROM12. A write driver 18 writes the write pulse WP indicated by Vw in FIG. 17 in write electrodes W1 to W7 at the timing defined by a timing signal Iwd.

In various foregoing embodiments in the row shift of a discharge spot forming one picture element, the discharge spot is shifted to the discharge points A, B, C, D, . . . one after another. This is performed by selecting the buses X1 to X3 in the order X1-X2-X3-X2-X1-X2- . . . and the buses Y1 to Y3 in the order Y1-Y2-Y1-Y2- . . . . Such a discharge spot drive method will hereinafter be referred to as the single cell scanning method.

On the other hand, there is a method of shifting a discharge spot while generating discharge spots, each forming one picture element, at adjoining discharge points. That is, by repeatedly supplying the shift pulses to such a combination of buses as (X1, X2, X3, Y1), (X3,Y1, X2), (X1, Y2, X3, Y2) and (X1, Y1, Y2), a discharge spot is shifted to the discharge points in a repeating cyclic order (A, B, C)-(C, D)-(D, E, F)- (F, A). This method will hereinafter be referred to as the common electrode scanning method since electrodes are used in common to one discharge spot.

Such a common electrode scanning method is also applicable to the column shift and, in this invention, both of the abovesaid methods can be employed.

The row shift operation by the single cell scanning method may be utilized in a write line, while only one of the buses Y1 and Y2 is activated in a display line. Thus, if the bus Y1 is selected and the buses X1 to X3 are pulsed in the order X1-X2-X3-X2-X1-X2- . . . as mentioned above, then a discharge spot is shifted in a repeating cyclic order to the discharge points A-B-C-B-A-B . . . . Thus the content already written in the display line is held while being swayed, and this method will hereinafter be referred to as the sway method.

Also, with the common electrode scanning method, the shift operation may take place only in the write line, if only one of the buses Y1 and Y2 is activated in the display line in the same manner as described above. Since the buses X1 to X3 are pulsed in a repeating cyclic order (X1, X2, X3)-(X3)-(X1,X2, X3)-(X1)-(X1, X2, X3), when the bus Y1 is pulsed, discharge spots are produced at the discharge points in the order (A, B, C)-(C)-(A, B, C)-(A)-(A, B, C), so that the content being displayed is held by the sway method in the display line.

By providing the buses X1 to both X3 in common to the write line and the display line and two different sets of the buses Y1 to Y3 for the write line and the display line, it is possible to display the written content while holding it by the sway method in the display line during the shift operation in the write line by either of the single cell scanning method and the common electrode scanning method.

Figure 22:
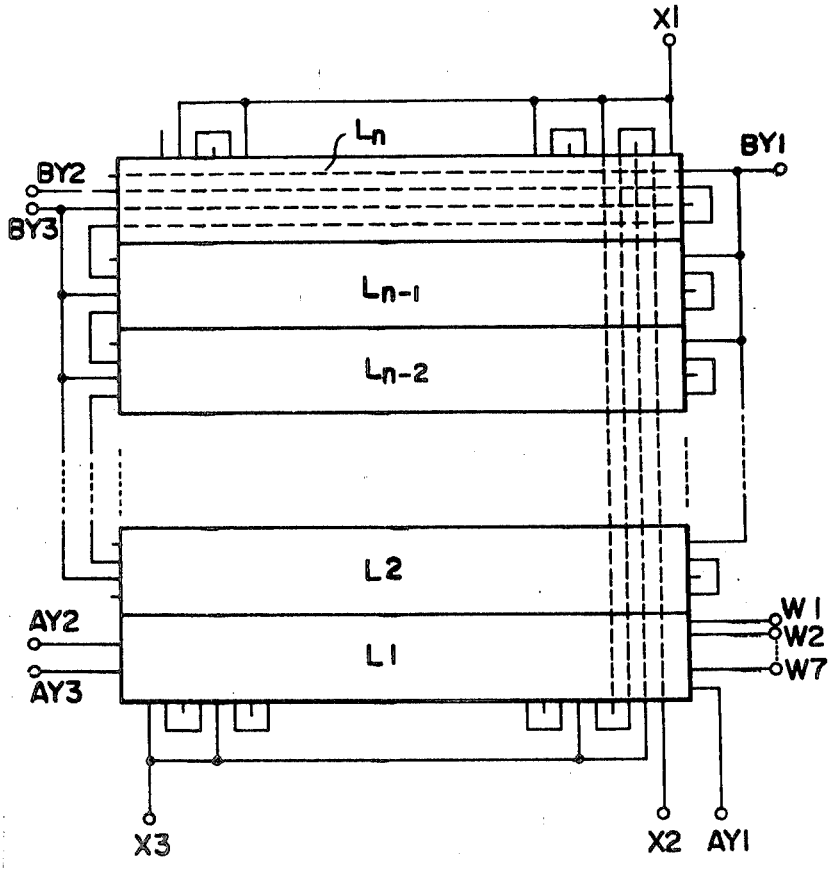
FIG. 22 is a schematic diagram explanatory of another embodiment of this invention having write and display lines.

FIG. 22 schematically shows a two-dimensional shift gas discharge panel having write and display lines. Reference character L1 indicates a write line, L2 to Ln designate display lines; W1 to W7 identify write electrodes for displaying one character, for example, with 5×7 dots; X1 to X3 denote buses common to the write line and the display lines; AY1 to AY3 represent buses of the write line; and BY1 to BY3 show buses of the display lines. The lines L1 to Ln have the electrode arrangements shown, for instance, in FIG. 9.

The buses X1 to X3 are sequentially selected in accordance with the single cell scanning method or the common electrode scanning method, and supplied with the shift pulses Vsh. During the write operation, the write electrodes W1 to W7 are selectively supplied with write pulses in accordance with information to be written, and the resulting discharge spots are sequentially shifted to the write line L1 by the application of the shift pulses Vsh to the buses AY1 and AY2 selected from the buses AY1 to AY3 described above. At this time, for instance, the bus BY1 is selected from the buses BY1 to BY3 as described previously, and supplied with the shift pulse Vsh, so that a discharge spot is produced by the sway method.

Upon application of the write operation, the contents in the write line L1 are shifted to the display line L2. By the control of the column shift mentioned above, that is, by a selective combination of the buses AY1 to AY3 and BY1 to BY3 with, for example, the buses X1 and X2, the written contents are sequentially shifted. If the buses BY1 to BY3 of the display lines L2 to Ln are led out independently line by line, the content to be displayed can be retained in a desired line by the control of the sway method during the column shift. Also, in the display line, the column shift can be effected.

Figure 23:
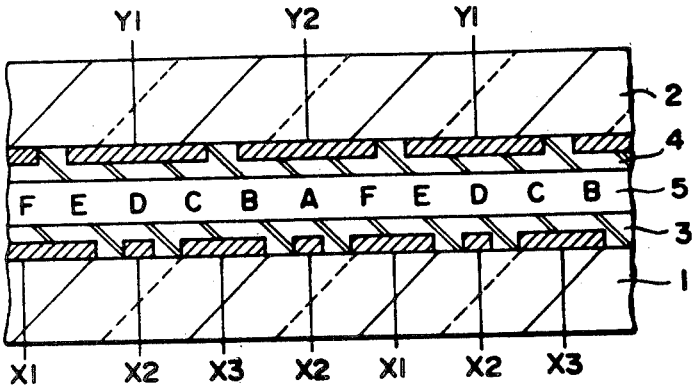
FIG. 23 is a cross-sectional view of the principal part of the structure of FIG. 15 taken along the row direction.
Figure 24:
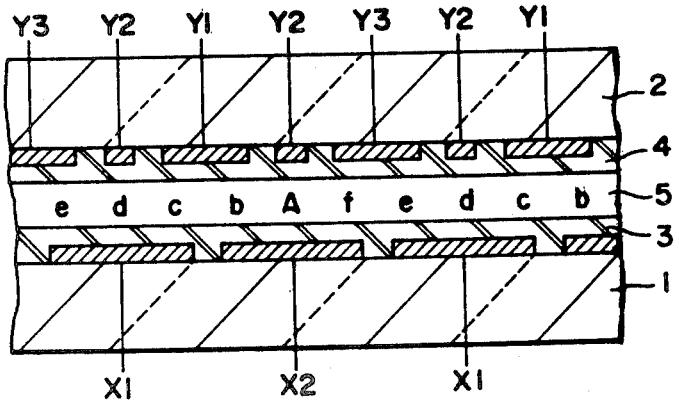
FIG. 24 is a cross-sectional view of the principal part of the structure of FIG. 15 taken along the column direction.

FIGS. 23 and 24 illustrate the cross-sections of the principal part of the self shift type gas discharge panel of FIG. 15 taken along the row direction and along the column direction, respectively. In FIGS. 23 and 24, reference numerals 1 and 2 indicate substrates as of glass; 3 and 4 designate dielectric layers as of a low-melting-point glass; and 5 identifies a space having sealed therein a discharge gas such as neon or the like. It is customary to cover each of the dielectric layers 3 and 4 with an ion shock-proof protective film as of MgO.

In the case of shifting a discharge spot in the row direction in the order of discharge points E-F-A-B-C-D, if the discharge spot is produced at the discharge point F by the application of shift pulses to the buses X1 and Y2, the discharge spot is shifted to the discharge point A by the application of shift pulses to the buses X2 and Y2, and then shifted only to the discharge point B by the subsequent application of shift pulses to the buses X3 and Y2.

In the case of shifting a discharge spot in the column direction in the order of discharge points e-f-A-b-c-d, if the discharge spot is generated at the discharge point f by the application of shift pulses to the buses X2 and Y3, the discharge spot is shifted to the discharge point A by the application of shift pulses to the buses X2 and Y2, and then shifted only to the discharge point b by the subsequent application of shift pulses to the buses X2 and Y1.

Figure 25:
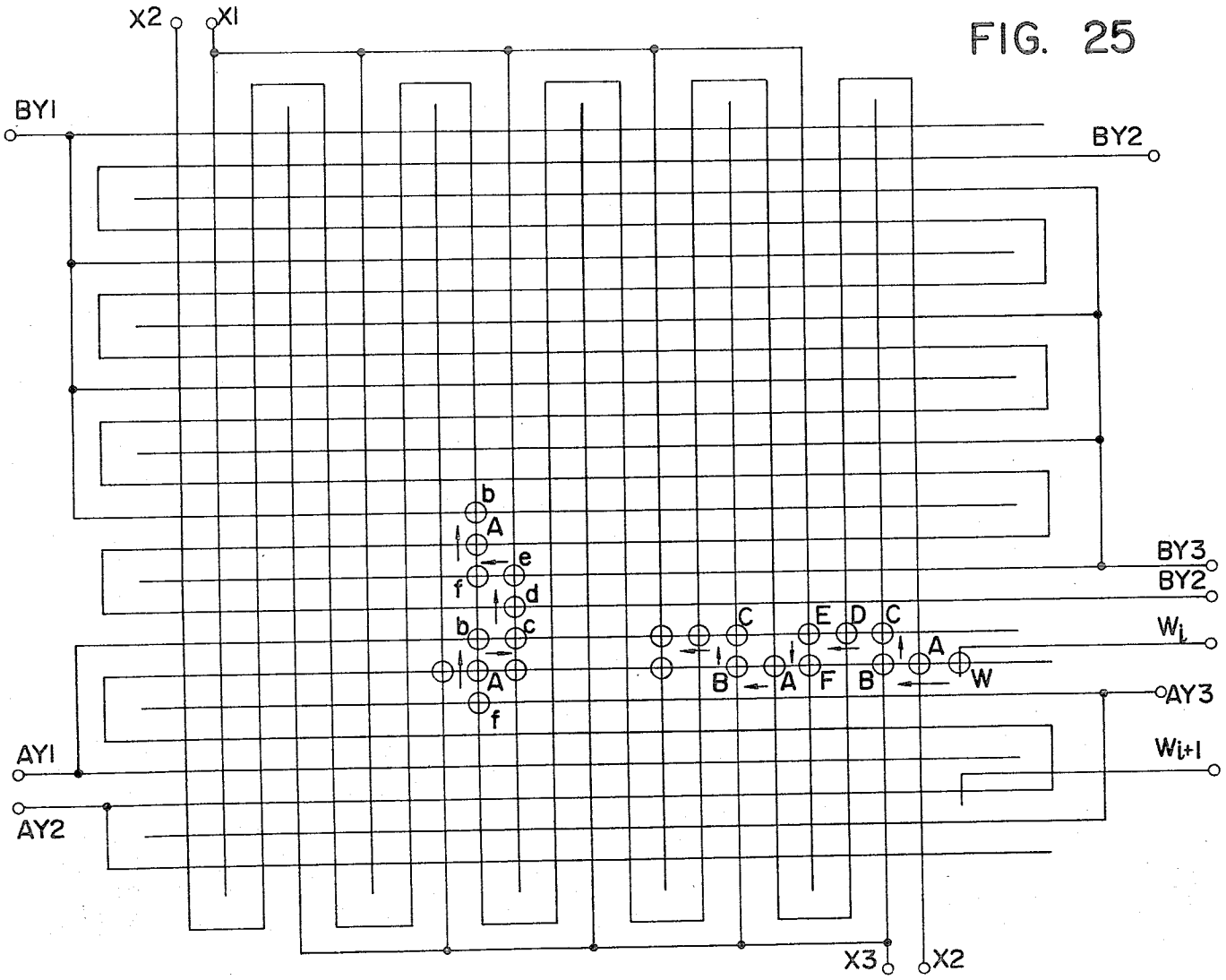
FIG. 25 is a schematic diagram explanatory of the connection of another embodiment of this invention having simplified the electrode arrangement of FIG. 15 and provided with write and display lines.

FIG. 25 shows, in a simplified form, the electrode arrangement of FIG. 15 in the case where write and display lines are provided in FIG. 16. A discharge spot written by a write electrode Wi is shifted by selective combinations of the buses X1 to X3 with AY1 and AY2 to discharge points W, A, B, C, . . . one after another. Since the discharge point A is the turning point, the discharge spot is shifted by selective combinations of the buses X1 and X2 with AY1 to AY3 and BY1 to BY3 in the column direction to discharge points A, b, c, d, . . . one after another.

Figure 26:
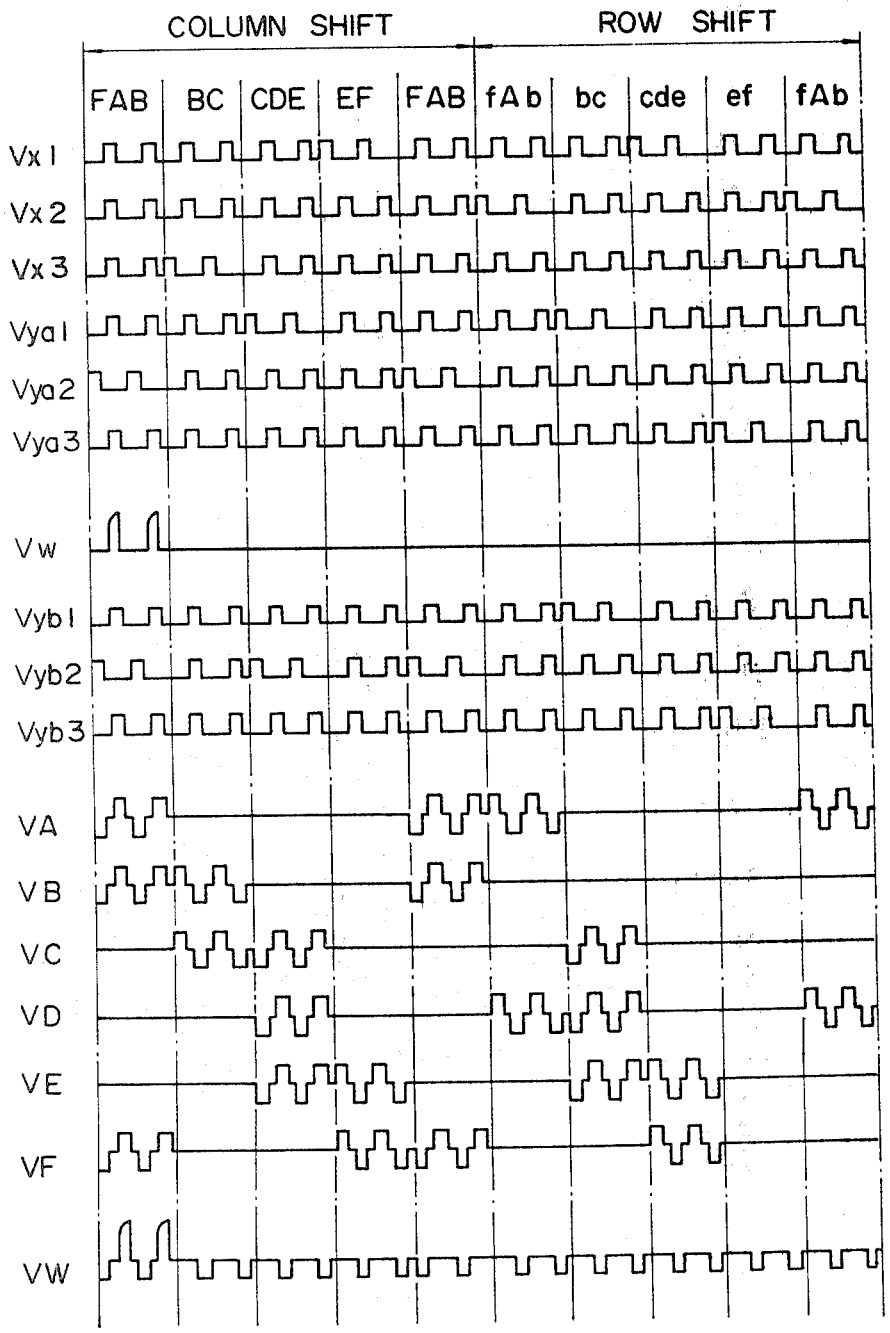
FIGS. 26 and 27 are respectively waveform diagrams showing drive waveforms for the gas discharge panel of the construction depicted in FIG. 25.
Figure 27:
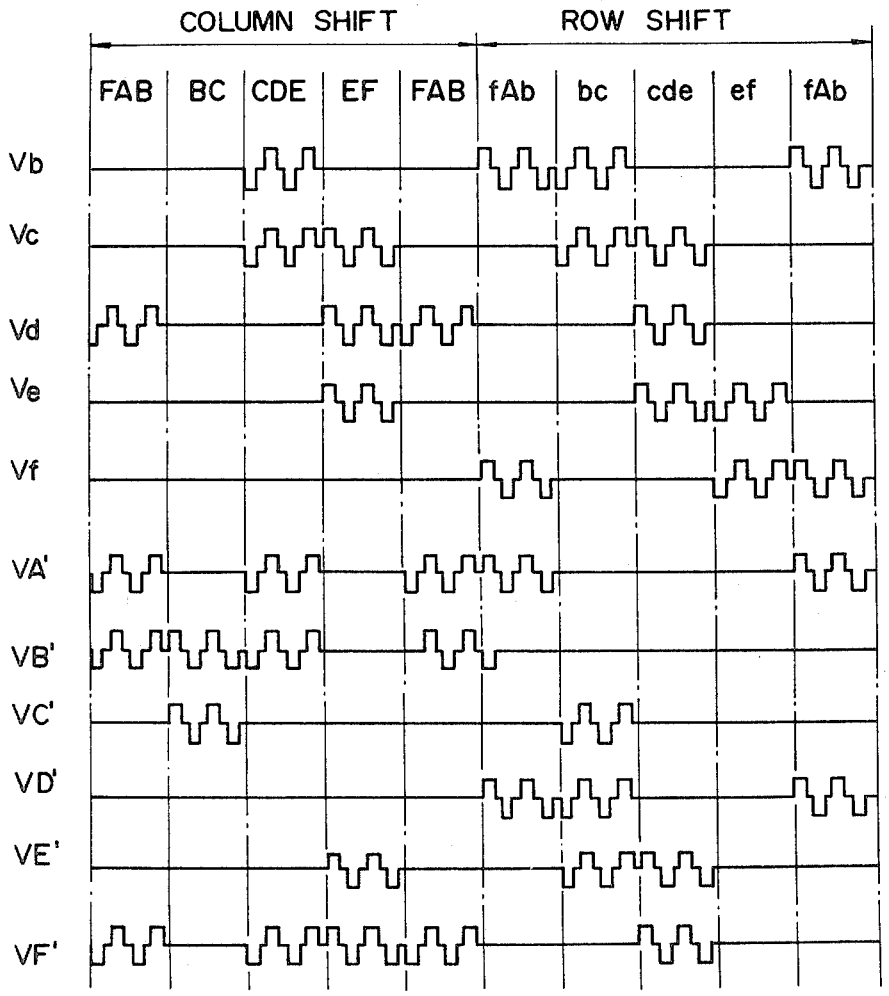

FIGS. 26 and 27 show an example of series of drive waveforms for the panel of the electrode arrangement of FIG. 25 in accordance with the common electrode scanning method. Vx1 to Vx3, Vya1 to Vya3, Vyb1 to Vyb3, Vw, VA to VF and VW show pulse voltage waveforms applied to the buses and discharge points, respectively; Vb to Vf show pulse voltage waveforms fed to the discharge points b to f, respectively; and VA' to VF' show pulse voltage waveforms applied to the discharge points A to F of the display lines, respectively.

When a discharge spot is produced at the write discharge point W by supplying a selected one of the write electrodes with the write pulse of the waveform Vw in a period FAB, since pulse voltages of the waveforms indicated by VF, VA and VB are fed to the discharge points F, A and B at that time, discharge spots are produced at the discharge points A and B adjacent the write discharge point W and at the discharge points F, A and B adjacent the position to which the discharge spot has been shifted. In the next period BC, the discharge spot shifts to the discharge points B and C. Further, in the subsequent period CDE, the discharge spot shifts to the discharge points, C, D, and E. Thereafter, the discharge spot is similarly shifted in the row direction.

In the abovesaid row shift, the pulse voltages indicated by VA' to VF' in FIG. 27 are fed to discharge points A to F of the display line, and a pulse voltage which is in-phase with those pulse voltages applied to the buses X2 and BY1, is applied to the discharge point D, with the result that no potential difference is produced, putting the discharge point D in a state equivalent to that in which no pulse voltage is applied thereto. Accordingly, the discharge spot is swayed between the discharge point E and C in the order (F, A, B,)→(B, C,)→(F, A, B,)→(E, F,)→(F, A, B,) . . . . Thus, during the row shift in the write line, the content to be displayed can be retained in the display line by the sway method.

In the period of column shift, pulse voltages of the same waveforms are supplied to the discharge points A to F of the write and display line and, in this case, since the pulse voltages are sequentially applied to the discharge points as indicated by Vb to Vf, a discharge spot is shifted in the order of the discharge points (f, A, b,)→(b, c,)→(c, d, e,)→(e, f,)→(f, A, b).

In FIGS. 26 and 27, no reference is made to the application of an erase pulse and in-phase pulse voltages are fed to buses than the selected X and Y buses, and thus no voltages are applied to the discharge points corresponding to them. In this case, however, if the pulse voltages have a small difference, pulse voltages of small width can result as erase pulses to the abovesaid discharge points.

Figure 28:
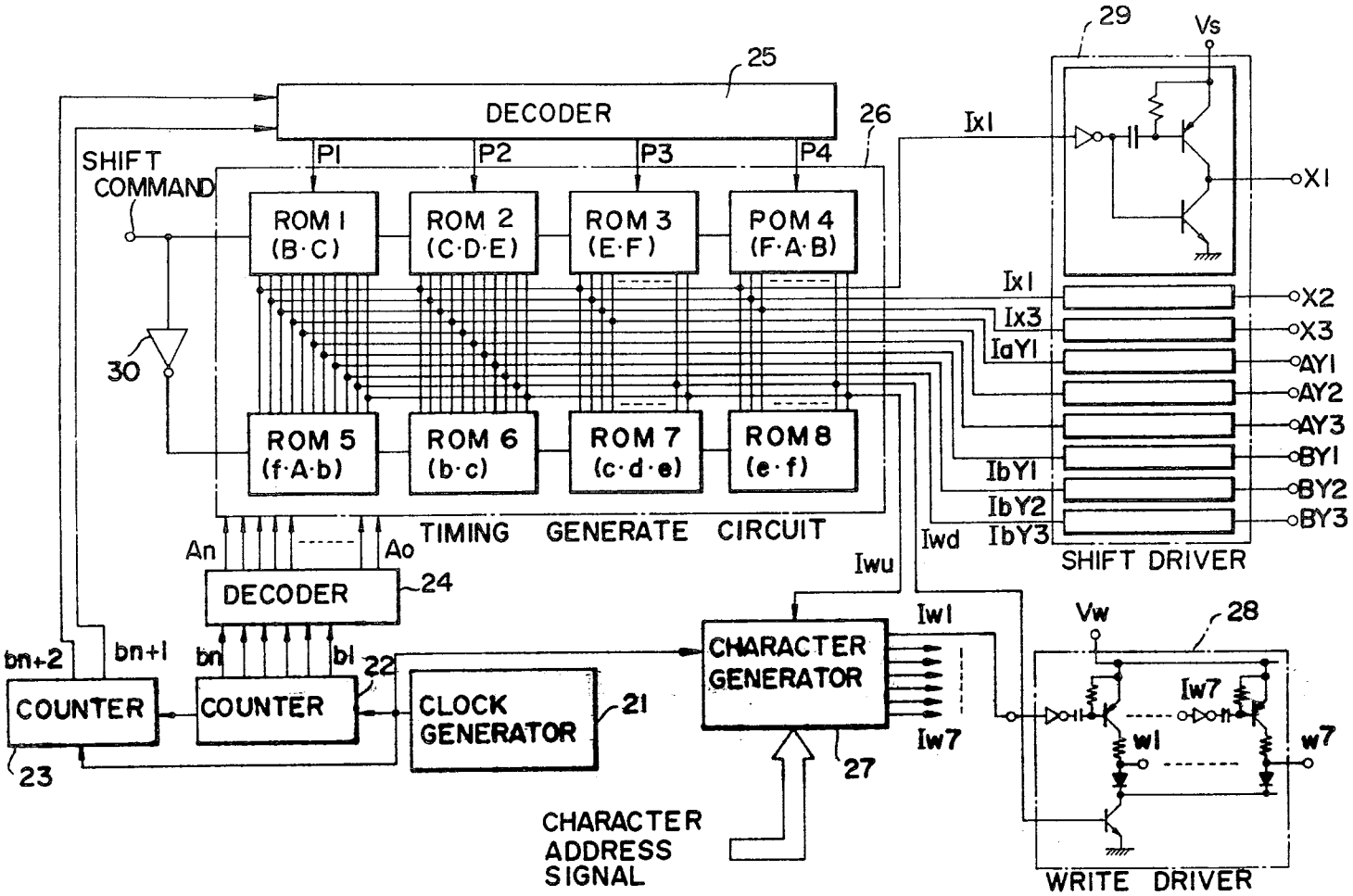
FIG. 28 is a block diagram illustrating an example of a drive circuit for generating pulse voltages of the drive waveforms depicted in FIGS. 26 and 27.

For performing the abovesaid shift operations, it is preferred to employ a drive circuit which is composed of read-only memories having stored therein the order of distribution of drive pulses of respective steps for the row shift and for the column shift, respectively. For example, in the case of driving a panel of such electrode structure of FIGS. 22 and 25 in accordance with the common electrode scanning method described with regard to FIGS. 26 and 27, it is possible to employ such a construction as illustrated in FIG. 28. In FIG. 28, read-only memories ROM1 to ROM4 included in a fundamental timing generate circuit 26 have respectively stored therein pulse generation timings corresponding to respective electrodes in four unit steps (B, C), (C, D, E), (E, F) and (F, A, B) in the row shift. The read-only memories ROM1 to ROM4 are sequentially read out with address signals A0 to An and P1 to P4 derived from decoders 24 and 25 based on outputs bl to bn, bn+1 and bn+2 from counters 22 and 23 which count clock pulses emanating from a clock generator 21 when a shift instruction signal is "1" to instruct the row shift, supplying drive timing signals Ix1 to IbY3 to a shift driver connected to the respective electrodes of the panel. Meanwhile, write timing signals Iwu and Iwd are read out of the read-only memory ROM4 corresponding to the phase of (F, A, B) at the same time as the memory ROM4 is addressed, and write information from a character generator 27, selected based on a character address signal applied thereto, is fed to a write driver 28 connected to write electrodes W1 to W7 at predetermined timings. When the shift instruction signal becomes "0" to instruct the column shift operation, the output from an inverter 30 becomes "1" and read-only memories ROM5 to ROM8 which have stored therein the pulse generation timings corresponding to the respective electrodes in four unit steps (f, A,b), (b, c), (c, d, e) and (e, f) in the column shift, are addressed with the outputs from the decoders 24 and 25 to read out timing signal for the column shift, thereby performing such a column shift operation as described previously in respect of FIGS. 26 and 27. In this case, it is possible to employ read-only memories, each having 11×24 addresses and drive pulse trains for the respective unit steps can be obtained with the sequence of sequentially reading out in parallel the contents, each composed of eleven lines.

As has been described in the foregoing, according to this invention, buses and electrodes do not cross over each other on each substrate, so that no cross-over parts are needed. This facilitates reduction of the electrode pitch, and hence provides a self shift type gas discharge panel capable of a high-resolution display. Further, since shift channels are formed both in the row and column directions, it is possible to shift in the row direction discharge spots indicative of written information while sequentially writing the information from one end of the panel and shift the discharge spots in the column direction upon completion of writing the information of one line. Thus, by repeating the above row and column shifts, information of a plurality of lines can be written and displayed.

Where the shift channels are formed with barriers in the row and column directions, the electrode structure is simplified and, although the shift channels become zigzag, the manufacture of electrodes is easy and the electrode pitch can be reduced. Where no barriers are employed, the shift channels in the row and column directions can be formed straight.

Further, the discharge point which is the turning point at the intersection of the row and column shift channels is formed with electrodes connected to buses through conductors of meander pattern configuration, by which an erroneous shift of a discharge spot can be prevented, providing for increased operating margin.

The present invention has many other advantages, and is not limited specifically to the foregoing embodiments and can be varied and modified without departing from the scope of the claims below.

What is claimed is:

1. A self shift type gas discharge panel, said panel having at least two intersecting shift channels for shifting at least one discharge spot along row and column directions, said panel comprising:

a pair of opposing substrates defining a gas discharge space therebetween;

a least two buses provided on each said substrate;

a number of pluralities of electrodes formed on each said substrate, said number of electrode pluralities on each said substrate being equal to the number of said buses on the same said substrate, and each said electrode on each of said substrates having at least one portion opposing a portion of at least one electrode on the other of said substrates;

means for connecting all the electrodes of each of said pluralities of electrodes on each said substrate respectively to one of said buses on the same said substrate;

a discharge point defined between each opposing pair of said opposing portions of said electrodes on said opposing substrates;

at least one array of said discharge points arranged along each of said row and column directions, and said at least two intersecting shift channels defined by said at least one array, and by said means for connecting said buses to said electrodes, to allow shifting of said at least one discharge spot selectively along said intersecting shift channels.

2. The panel of claim 1, wherein each one of said at least one array along each of said directions has at least one of said discharge points in common with at least one of said at least one array in the other of said directions.

3. The panel of claim 1, comprising a plurality of periodically arranged intersection points of said intersecting shift channels, wherein the number of said discharge points defining the period between corresponding consecutive pairs of said intersection points of said shift channels in said row and column directions is equal to the total number of said buses.

4. The panel of claim 1, wherein each of said electrode pluralities on each of said substrates are disposed to define respectively a plurality of lines on the same said substrate, all of said pluralities of lines on each substrate being along one of said row and column directions, with said direction of said lines on one of said substrates being different from said directions of said lines on the other of said substrates, and all of said lines corresponding to each one of said pluralities of electrodes on each substrate being arranged alternately with said lines corresponding to the at least one other of said pluralities of lines on the same said substrate; and said pluralities of lines are formed with the respective configurations such that, in conjunction with said means for connecting said electrodes arranged in said lines to said buses, said shift channels are defined along consecutive adjacent pairs of said discharge points.

5. The panel of claim 4 further comprising barriers for defining said shift channels.

6. The panel of claim 5 wherein said lines on at least one of said substrates are periodically displaced at said at least one intersection point of said shift channels, said displacement allowing said shifting of said at least one discharge spot into a selected one of said intersecting shift channels as a result of voltage pulses of different phases being applied to said buses.

7. The panel of claim 6, wherein said shift channels comprise straight shift channels along one of said directions and repetitively bending shift channels along the other of said directions.

8. The panel of claim 7 comprising two buses and two respectively connected pluralities of electrodes on each of said substrates, and wherein said repetitively bending shift channels are arranged for shifting said at least one discharge spot along said row direction, and the repetitive bends of said repetitively bending shift channels along said row direction occur at every two of said discharge points along said channel; and said straight shift channels are disposed along said column direction, said periodic displacement of said lines of electrodes being provided at steps of every two discharge points, said displacement being in said row direction, and said displacement being in magnitude equal to an odd number of pairs of said alternating lines of electrode pluralities in said column direction.

9. The panel of claim 5 comprising:

at least three of said buses on each said substrate;

means for connecting respectively first and second ones of said pluralities of lines of electrodes on each said substrate to the respective two of said buses by extending each of said two buses at right angles to the direction of said pluralities of lines on the same said substrate, each one of said respective two buses disposed on different sides of said lines, and said connecting means extending along said lines to respectively connect said electrodes to each said bus; and means for connecting respectively in common the third and any more of said at least three pluralities of lines of electrodes on each said substrate to the corresponding ones of said buses by connecting alternately opposite ends of consecutive pairs of said lines of each of at least said third and anymore of said at least three pluralities of lines.

10. The panel of claim 9 comprising:

three of said buses on each of said substrates, each of said buses connected as said to each respective one of said equal number of pluralities of lines of electrodes;

each of said shift channels comprising a periodically repeated configuration of a first three of said adjacent discharge points along each one of row and column directions followed by a second three of said discharge points along the same corresponding direction but shifted one adjacent line in the other of said directions, the third discharge point of said first three adjacent discharge points being adjacent to the first discharge point of said second three adjacent discharge points but in said other direction, each intersection point of said intersecting shift channels comprising the commonality of the third one of said second three discharge points in each of said directions with the second one of said first three discharge points in the other of said directions; and such of said barriers as are needed to restrict said discharge spots to said periodic configuration.

11. The panel of claim 9 wherein said intersecting shift channels have a periodic configuration and wherein the number of said discharge points in each unit period of said periodic configuration is equal to the total number of said buses.

12. The panel of claim 1, having a plurality of said shift channels extending along each of said row and column directions, said panel comprising:

at least three of said buses on each of said substrates;

selected ones of said electrodes of said equally numbered electrode pluralities on each said substrate having a plural number of said portions opposing corresponding portions of said electrodes on the other said substrate; and said connecting means comprising means for connecting a selected two of said buses on at least one of said substrates to each pair of adjacent electrodes on the same said substrates, said two selected buses being chosen for each adjacent pair of electrodes depending upon which of said discharge spots of said shift channels along which of said directions said two adjacent electrodes pertain.

13. The panel of claim 12, comprising:

three of said buses on each said substrate;

connecting means for alternately connecting consecutive ones of said adjacent electrodes having said portions defining said discharge points along a first of said directions on one of said substrates to a selected two of said three buses on the same said substrate, and for respectively connecting ones of said electrodes having said portions defining said discharge points along the second of said directions on the same said substrate to said three buses with the order that one of said three buses is connected alternately to every second one of said electrodes while the other ones of said consecutive electrodes are alternately connected to the other two of said buses; and similar connecting means on the other of said substrates with a respective change of said electrode connections to respective ones of said buses so that said alternate connection of said consecutive electrodes to a respective two of said buses are for electrodes having portions defining said discharge points along the second of said directions, and said electrodes connected to a respective three of said electrodes are for electrodes having portions defining said discharge points along the first of said directions.

14. The panel of claim 13 comprising:

three of said buses on each said substrate, one of each of two of said buses on each said substrate extending along a first of said directions on a first of said substrates and along a second of said directions on the second of said substrates, each of said two extending buses on each said substrate disposed along a corresponding one of the two sides of said pluralities of electrodes on the same said substrate;

said means for connecting said two buses on each said substrate to corresponding ones of said electrode pluralities comprising first and second connection means alternately extending from each of said extending buses respectively to selected groups of electrodes of each of said corresponding electrode pluralities, each of said selected electrode groups being regularly arranged along each said extending connection; and said connecting means for connecting the third of said buses on each substrate respectively to the third of said electrode pluralities on each substrate comprising a third connecting means interposed between said alternately extending first and second connection means, said third connecting means comprising portions in the direction of said first and second extending connection means on the same one of each said substrate, each pair of consecutive ones of said portions of said third connecting means being alternately connected at the ends of said portions in the vicinity of the respective ones of said first two extending buses on each said substrate.

15. The panel of claim 14 wherein each intersection of said intersecting shift channels occurs at electrodes of said third plurality of electrodes on each substrate.

16. The panel of claim 12 wherein said intersecting shift channels intersect at regularly spaced intervals, the number of said discharge points in each said interval being equal to the total number of said buses.

17. The panel of claim 1, 2, 3, 4, 9 or 10, wherein said connecting means comprises means for connecting each of said buses respectively to each of said electrode pluralities without any crossover.

18. The panel of claim 12, wherein first and second ones of said at least three buses on each said substrates are extended along respective sides of said electrode pluralities on each substrate, one of said first and second buses on each substrate extending on one side of said electrode pluralities, and the other of said first and second buses extending on the other side of said electrode pluralities, said extending buses on one of said substrates extending in a different one of said directions than said extending buses on the other of said substrates;

said connecting means comprises first and second connecting means for said first and second buses on each substrate, said first and second connecting means comprising connecting means alternately extending from each of said first and second buses on each of said substrates in the form of intermeshing combs, the teeth of said intermeshing combs on one substrate being transverse to the teeth of said intermeshing combs on the other substrate, each one of said combs connecting one of said pluralities of electrodes and each said pluralities of electrodes being divided into groups of said electrodes with each group disposed along one of said teeth of each comb, each said tooth not necessarily comprising a linear configuration; and said connecting means further comprises at least a third connecting means connecting respectively at least a third bus of said at least three buses to corresponding ones of said equally numbered pluralities of electrodes on each substrate, said at least a third connecting means comprising means for connecting electrodes of each respective one of said at least a third electrode plurality, each of said electrode pluralities on each substrate being grouped into a plurality of groups, each said group being disposed between said teeth of said combs of said first and second connecting means, and each said group of said at least a third electrode plurality being respectively connected at alternate ends to form a meander type connection between said teeth of said intermeshing comb form, there being one such meander type connecting means connecting each one of said at least a third electrode pluralities respectively to said at least a third bus on each substrate.

19. The panel of claim 1 wherein each of the electrodes, between said opposing portions of which at least one of the adjacent pair of said discharge points are defined, are connected to different corresponding ones of said buses.

20. The panel of claim 1, wherein for at least one adjacent pair of said discharge points of said shift channels in at least one of said directions there is one electrode in common to both of said adjacent discharge points.

* * * * *

UNITED STATES PATENT AND TRADEMARK OFFICE

CERTIFICATE OF CORRECTION

PATENT NO. : 4,249,104 PAGE 1 OF 9

DATED : February 3, 1981

INVENTOR(S) : Shinoda et al.

It is certified that error appears in the above—identified patent and that said Letters Patent is hereby corrected as shown below:

Front page, [73] Assignee, "Tokyo" should be --Kawasaki--.

Column 1, line 18, delete the word "a";

line 38, "electrode and shift." should be --shift electrodes.--;

line 60, "fabirica-" should be --fabrica- --.

Column 2, line 12, "phnomenon" should be --phenomenon--;

line 41, after "(i=1, 2, 3, ...)" insert --,--.

Column 3, line 7, "point a" should be --point *a*-- (italicized);

lines 9, 10, 15 and 16, "point b" should be --point *b*-- (italicized);

lines 12 and 13, "point c" should be --point *c*-- (italicized);

line 17, "c" should be --*c*-- (italicized;

line 18, "d, e, f," should be --*d*, *e*, *f*,-- (italicized);

line 22, "3 ...)" should be --3, ...)--;

line 26, "(J=1, 2, 3, ...)" should be --(j=1, 2, 3, ...)--;

line 53, delete "of";

line 59, delete "of the construction".

Column 4, line 25, change "discussed;" to --discussed above;--;

UNITED STATES PATENT AND TRADEMARK OFFICE

CERTIFICATE OF CORRECTION

PATENT NO. : 4,249,104 PAGE 2 OF 9

DATED : February 3, 1981

INVENTOR(S) : Shinoda et al.

It is certified that error appears in the above—identified patent and that said Letters Patent is hereby corrected as shown below:

line 53, change "arrangement;" to --arrangement of FIG. 9;--;

lines 65-66, "FIG. 17" should begin a new paragraph.

Column 5, line 6, change "invention." to --invention;--;

line 39, after "buses" delete ";";

line 55, "and are y3j, and" should be --and y3j, and are--.

Column 6, line 5, "point a" should be --point a-- (italicized); "timing" should be --time--;

line 7, "point b" should be --point b-- (italicized);

line 11, "point c." should be --point c.-- (italicized);

line 37, "point f" should be --point f-- (italicized);

line 40, change "point g" to --point g-- (italicized);

line 43, "point g'" should be --point g'-- (italicized);

line 45, "point h'" should be --point h'-- (italicized);

line 48, "g'(X1, Y3)" should be --g'(X1, Y3),--;

line 49, "1'" should be --ℓ'--;

line 61, "1''" should be --ℓ''--.

Column 7, line 4, "one to one" should be --one-to-one--;

UNITED STATES PATENT AND TRADEMARK OFFICE

CERTIFICATE OF CORRECTION

PATENT NO. : 4,249,104 PAGE 3 OF 9

DATED : February 3, 1981

INVENTOR(S) : Shinoda et al.

It is certified that error appears in the above—identified patent and that said Letters Patent is hereby corrected as shown below:

line 22, delete "of";

line 35, "wl(l=1, 2, 3, ...)" should be --wℓ(ℓ=1, 2, 3, ...)--;

line 38, delete "the case of"; delete "in the row direction";

line 48, "point e" should be --point *e*-- (italicized);

line 50, "point c'" should be --point *c*'-- (italicized);

line 53, "point b'" should be --point *b*'-- (italicized);

line 56, "e to c' or from b'" should be --*e* to *c*' or from *b*'-- (italicized);

lines 57 and 61, "d'" should be --*d*'-- (italicized);

line 67, delete "is".

Column 8, line 32, "c' and b'" should be --*c*' and *b*'-- (italicized);

line 45, "xlli to x3li" should be --xlℓi to x3ℓi--;

line 47, "wl(l, i, j,=1, 2, 3, ...)," should be --"wℓ(ℓ, i, j=1, 2, 3, ...),--;

line 48, "yllk," should be --ylℓk,--;

line 49, "y2lk," should be --y2ℓk,--; "(l," should be --(ℓ,--;

UNITED STATES PATENT AND TRADEMARK OFFICE

CERTIFICATE OF CORRECTION

PATENT NO. : 4,249,104 PAGE 4 OF 9

DATED : February 3, 1981

INVENTOR(S) : Shinoda et al.

It is certified that error appears in the above—identified patent and that said Letters Patent is hereby corrected as shown below:

line 51, "abovesaid" should be --above--;

line 52, delete "the";

line 56, "x111, x211, x311, x212, x112, x213, x312," should be --xlℓ1, x2ℓ1, x3ℓ1, x2ℓ2, xlℓ2, x2ℓ3, x3ℓ2,--;

line 57, "y111, y211, y112, y212," should be --ylℓ1, y2ℓ1, ylℓ2, y2ℓ2,--;

line 63, "x11i and x31i" should be --xlℓi and x3ℓi--;

line 65, "x21i" should be --x2ℓi--.

Column 9, line 1, "y11k, y21k," should be --ylℓk, y2ℓk,--;

line 23, "be" should be --by--;

line 28, "-(xl, Yl)-" should be -- -(Xl, Yl)- --;

line 39, "xl i and yl k," should be --xli and ylk,--;

line 51, "(Xl.Yl)-(Xl, Y2)-(xl, Y3)-(X2," should be --(Xl, Yl)-(Xl, Y2)-(Xl, Y3)-(X2,--;

line 64, "x11i and y11k" should be --xlℓi and ylℓk--;

line 65, "x21i and y11k," should be --x2ℓi and ylℓk,--;

line 66, "wl." should be --wℓ.--.

Column 10, line 14, "the both" should be --both the--;

line 40, "w" should be --*w*-- (italicized).

UNITED STATES PATENT AND TRADEMARK OFFICE

CERTIFICATE OF CORRECTION

PATENT NO. : 4,249,104 PAGE 5 OF 9

DATED : February 3, 1981

INVENTOR(S) : Shinoda et al.

It is certified that error appears in the above—identified patent and that said Letters Patent is hereby corrected as shown below:

Column 11, line 2, "a to d." should be --*a* to *d*.-- (italicized);

line 4, "c(g)," should be --*c*(*g*),-- (italicized);

line 5, "a'(X1, Y1)-d'(X2, Y1)-b'(X1, Y2)-" should be --"*a*'(X1, Y1)-*d*'(X2, Y1)-*b*'(X1, Y2)- -- (italicized);

line 6, "c(X2," should be --*c*(X2,-- (italicized);

line 7, "c to a' and d' to b'" should be --*c* to *a*' and *d*' to *b*'-- (italicized);

line 8, "a' to d' and b' to c" should be --*a*' to *d*' and *b*' to *c*-- (italicized);

line 12, "c to a'," should be --*c* to *a*',-- (italicized);

line 13, "a or e" should be --*a* or *e*-- (italicized);

line 15, "a'." should be --*a*'.-- (italicized);

line 16, "d' and d," should be --*d*' and *d*,-- (italicized);

line 17, "a' to d'" should be --*a*' to *d*'-- (italicized);

line 20, "e to d" should be --*e* to *d*-- (italicized);

line 21, "point a" should be --point *a*-- (italicized);

line 23, "b' and b," should be --*b*' and *b*,-- (italicized);

UNITED STATES PATENT AND TRADEMARK OFFICE

CERTIFICATE OF CORRECTION

PATENT NO. : 4,249,104 PAGE 6 OF 9

DATED : February 3, 1981

INVENTOR(S) : Shinoda et al.

It is certified that error appears in the above—identified patent and that said Letters Patent is hereby corrected as shown below:

line 24, "d' to b'" should be --d' to b'-- (italicized);

line 26, "c" should be --c-- (italicized); "d and b," should be --d and b,-- (italicized);

line 40, "w" should be --w-- (italicized);

line 42, "a, b, c and d" should be --a, b, c and d-- (italicized);

line 46, "a to b, c to d and d' to c'," should be --a to b, c to d and d' to c',-- (italicized);

line 47, "a' to b" should be --a' to b-- (italicized);

line 51, change "crossover" to --cross-over--;

line 55, "logical" should be --logic--;

line 63, "b to f." should be --b to f.-- (italicized).

Column 12, line 3, "b," should be --b,-- (italicized);

line 6, "f" should be --f-- (italicized);

line 9, "b" should be --b-- (italicized);

line 10, "f" should be --f-- (italicized);

line 11, "b or F and f" should be --b or F and f-- (italicized);

UNITED STATES PATENT AND TRADEMARK OFFICE

CERTIFICATE OF CORRECTION

PATENT NO. : 4,249,104 PAGE 7 OF 9

DATED : February 3, 1981

INVENTOR(S) : Shinoda et al.

It is certified that error appears in the above—identified patent and that said Letters Patent is hereby corrected as shown below:

line 31, "zigzag" should be --meander pattern--;

line 32, "adjoining F" should be --adjoining A--;

line 43, delete the second occurrence of "of";

line 53, "f" should be --*f*-- (italicized);

line 57, "b" should be --*b*-- (italicized).

Column 13, line 1, "pulses" should be --pulse--;

line 5, "Vw" should be --VW--;

line 22, "A and b to f" should be --*A* and *b* to *f*-- (italicized);

line 24, "b to f," should be --*b* to *f*,-- (italicized);

line 25, "b to f" should be --*b* to *f*-- (italicized);

line 38, "zigzag" should be --meander pattern--;

line 47, "b to h," should be --*b* to *h*,-- (italicized);

line 58, "Y3 and," should be --Y3, and--.

*Column 14, line 28, "Vw" should be --VW--;

line 31, "embodiments" should be --embodiments,--;

line 44, "(X3,Y1, X2)," should be --(X3, Y1, Y2)--;

"(X1, Y2, X3, Y2)" should be --(X1, X2, X3, Y2)--;

*line 60, "Thus" should be --Thus,--.

UNITED STATES PATENT AND TRADEMARK OFFICE

CERTIFICATE OF CORRECTION

PATENT NO. : 4,249,104 PAGE 8 OF 9

DATED : February 3, 1981

INVENTOR(S) : Shinoda et al.

It is certified that error appears in the above—identified patent and that said Letters Patent is hereby corrected as shown below:

Column 15, line 6, "both X3 in common to" should be --X3 in common to both--;

line 7, "display line" should be --display line,--;

line 9, "line," should be --lines,--.

Column 16, line 3, "point f" should be --point f-- (italicized);

line 7, "point b" should be --point b-- (italicized);

line 28, "b to f," should be --b to f,-- (italicized);

line 34, "Vw" should be --VW--;

line 39, "point W" should be --points W--;

line 44, "points," should be --points--.

*Column 17, line 3, before "than" insert --other--;

line 6, before "difference," insert --phase--;

line 49, change "in respect of" to --with respect to--.

*Column 18, line 6, "zigzag," should be --meander pattern,--;

line 27, change "a" to --at--;

line 61, change "are" to --is--.

UNITED STATES PATENT AND TRADEMARK OFFICE

CERTIFICATE OF CORRECTION

PATENT NO. : 4,249,104 PAGE 9 OF 9

DATED : February 3, 1981

INVENTOR(S) : Shinoda et al.

It is certified that error appears in the above—identified patent and that said Letters Patent is hereby corrected as shown below:

Column 19, line 12, "5" should be --5,--.

Column 20, line 63, "13" should be --13,--.

Column 21, line 28, "14" should be --14,--;

line 31, "12" should be --12,--.

Column 22, line 38, "1" should be --1,--;

line 40, "pair" should be --pairs--.

Signed and Sealed this

*Twentieth* Day of *October 1981*

[SEAL]

*Attest:*

GERALD J. MOSSINGHOFF

*Attesting Officer* *Commissioner of Patents and Trademarks*